United States Patent [19]

Sakanoue et al.

[11] Patent Number: 4,789,624

[45] Date of Patent: Dec. 6, 1988

[54] SILVER HALIDE COLOR PHOTOGRAPHIC LIGHT-SENSITIVE MATERIAL

[75] Inventors: Kei Sakanoue; Shigeo Hirano; Takehiko Ueda; Keiichi Adachi, all of Kanagawa, Japan

[73] Assignee: Fuji Photo Film Co., Ltd., Kanagawa, Japan

[21] Appl. No.: 42,612

[22] Filed: Apr. 21, 1987

Related U.S. Application Data

[63] Continuation of Ser. No. 696,544, Jan. 30, 1985, abandoned, which is a continuation-in-part of Ser. No. 572,471, Jan. 20, 1984, abandoned.

[30] Foreign Application Priority Data

Jan. 20, 1983 [JP] Japan ..... 58-7692

[51] Int. Cl.[4] ..... G03C 7/34; G03C 7/36; G03C 7/38

[52] U.S. Cl. ..... 430/372; 430/383; 430/505; 430/551; 430/553; 430/557; 430/558

[58] Field of Search ..... 430/551, 505, 543, 553, 430/372, 557, 376, 558 A, 383

[56] References Cited

U.S. PATENT DOCUMENTS

| | | | |
|---|---|---|---|
| 3,069,262 | 12/1962 | Haas | 430/237 |
| 3,457,079 | 7/1969 | Koda et al. | 430/542 |
| 3,926,631 | 12/1975 | Arai et al. | 430/555 |
| 4,199,361 | 4/1980 | Furutachi | 430/554 |
| 4,228,235 | 10/1980 | Okonogi et al. | 430/372 |
| 4,254,216 | 3/1981 | Uchida et al. | 430/372 |
| 4,264,723 | 4/1981 | Ichijima et al. | 430/555 |

*Primary Examiner*—Richard L. Schilling
*Attorney, Agent, or Firm*—Sughrue, Mion, Zinn, Macpeak, and Seas

[57] ABSTRACT

A silver halide color photographic light-sensitive material which contains a high speed reactive type coupler having a relative coupling speed of 0.35 to 1.0 and a compound represented by the following general formula (I):

(I)

wherein R represents a hydrogen atom, a substituted or unsubstituted aliphatic group, a substituted or unsubstituted aromatic group, or a substituted or unsubstituted heterocyclic group.

The silver halide color photographic light-sensitive material provides color images having greatly improved graininess in both high density areas and low density areas, without adversely affecting sensitivity.

32 Claims, No Drawings

SILVER HALIDE COLOR PHOTOGRAPHIC LIGHT-SENSITIVE MATERIAL

CROSS REFERENCE TO RELATED APPLICATION

This is a continuation of application Ser. No. 696,544 filed Jan. 30, 1985, now abandoned, which is a continuation-in-part of U.S. Ser. No. 572,471, now abandoned, filed Jan. 20, 1984.

FIELD OF THE INVENTION

The present invention relates to a color photographic light-sensitive material and, more particularly, to a silver halide color photographic light-sensitive material improved in graininess.

BACKGROUND OF THE INVENTION

The present invention improve the graininess of silver halide photographic light-sensitive materials is an important subject in the field of such photographic materials and much information relating thereto has been accumulated.

For instance, Japanese Patent Application (OPI) No. 62454/80 discloses the use of a high speed reactive coupler, wherein graininess in high density image areas is markedly improved. This is because such a coupler reacts rapidly with the oxidation product of a color developing agent and, consequently, a development restraining effect caused by the oxidation product of color developing agent is diminished and, at the same time, the amount of developed silver in highly exposed areas is increased. Under these conditions, all of the coupler molecules coated undergo the reaction and thereby any granular condition becomes inconspicuous, that is to say, disappearance of the granular structure occurs quickly. However, high speed reactive couplers have a serious defect that they form dye clouds of high densities due to the rapid reaction with the oxidation products of color developing agents and thereby graininess in low density image areas is extremely deteriorated.

In order to eliminate such a defect, methods of using high speed reactive couplers in combination with the so-called DIR couplers of DIR compounds, which tend to break up dye clouds into fine pieces improving graininess are disclosed in U.S. Pat. Nos. 3,227,554 and 3,632,435, respectively. However, such methos are not desirable because restrainers released upon development counteract the effect of the high speed reactive couplers, that is, the effect of improving the graininess in high density image areas is suffered.

On the other hand, U.S. Pat. No. 3,457,079 discloses gallic acid esters added to silver halide emulsion layers. Color formers are disclosed. However, the gallic acid esters are not employed in combination with any high speed reactive type couplers. The gallic acid esters of the U.S. patent are used to stabilize silver halid emulsion during storage prior to exposure. As a natural consequence, no graininess problem is taken into accout.

SUMMARY OF THE INVENTION

Therefore, an object of the present invention is to provide a method for improving graininess in low density image areas after exposure and development, without spoiling the effect of extinguishing a granular appearance in high density image areas which is brought about my high speed reactive couplers.

Another object of the present invention is to provide a color photographic light-sensitive material which forms images having greatly improved graininess in both high density areas and low density areas after exposure to light and development subsequent thereto.

These and other objects of the present invention will become apparent from the following detailed description and examples.

As a result of various investigations, it has now been found that the above-described objects can be attained by adding a combination of a gallic acid ester series compound represented by the general formula (I) described below with a highspeed reactive type coupler to a silver halide color photographic light-sensitive material:

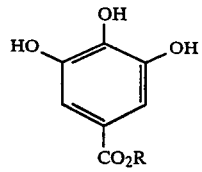

(I)

wherein R represents a hydrogen atom, a substituted or unsubstituted aliphatic group, a substituted or unsubstituted aromatic group, or a substituted or unsubstituted heterocyclic group.

DETAILED DESCRIPTION OF THE INVENTION

In the general formula (I), suitable examples of the aliphatic group represented by R include a straight chain or branched chain alkyl group, a straight chain or branched chain alkenyl group, a cycloalkyl group, and a straight chain or branched chain alkynyl group.

The straight chain or branched chain alkyl group has from 1 to 30 carbon atoms, preferably from 1 to 20 carbon atoms. Preferred examples thereof include a methyl group, an ethyl group, a propyl group, an n-butyl group, a sec-butyl group, a t-butyl group, an n-hexyl group, a 2-ethylhexyl group, an n-octyl group, a t-octyl group, an n-dodecyl group, an n-hexadecyl group, an n-octadecyl group, an iso-stearyl group, an eicosyl group and the like.

The straight chain or branched chain alkenyl group has from 2 to 30 carbon atoms, preferably from 3 to 20 carbon atoms. Preferred examples thereof include an allyl group, a butenyl group, a pentenyl group, an octenyl group, a dodecentyl group, an oleyl group and the like.

The cycloalkyl group has from 3 to 12 carbon atoms, preferably from 5 to 7 carbon atoms. Preferred examples thereof include a cyclopropyl group, a cyclopentyl group, a cyclohexyl group, a cycloheptyl group, a cyclododecyl group and the like.

The straight chain or branched chain alkynyl group has from 3 to 30 carbon atoms, preferably from 3 to 22 carbon atoms. Preferred examples thereof include a propargyl group, a butynyl group and the like.

Preferred examples of the aromatic group represented by R include a phenyl group and a naphthyl group.

Preferred examples of the heterocyclic group represented by R include a thiazolyl group, an oxazolyl group, an imidazolyl group, a furyl group, a thienyl group, a tetrahydrofuryl group, a piperidyl group, a thiadiazolyl group, an oxadiazolyl group, a benzothiazolyl group, a benzoxazolyl group, a benzimidazolyl group and the like.

Each of the above-described groups may have an appropriate substituent. Preferred examples of such substituents include an alkoxy group, an aryloxy group, a hydroxy group, an alkoxycarbonyl group, an aryloxycarbonyl group, a halogen atom, a carboxy group, a sulfo group, a cyano group, an alkyl group, an alkenyl group, an aryl group, an alkylamino group, an arylamino group, a carbamoyl group, an alkylcarbamoyl group, an arylcarbamoyl group, an acyl group, a sulfonyl group, an acyloxy group, an acylamino group and the like.

Preferred examples of the compound represented by the general formula (I) according to the present invention are illustrated below. However, the compound according to the present invention should not be construed as being limited to the following examples.

(I-1)

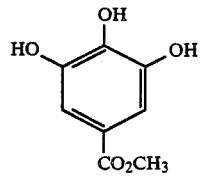

(I-2)

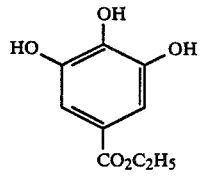

(I-3)

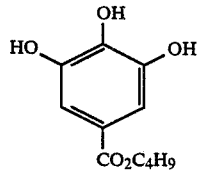

(I-4)

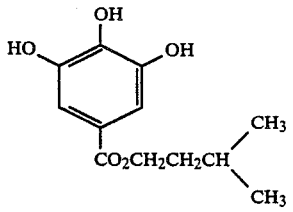

(I-8)

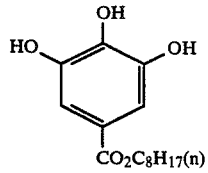

(I-9)

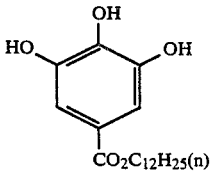

-continued (I-10)

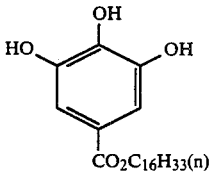

(I-11)

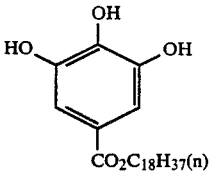

(I-12)

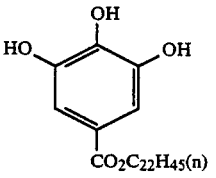

(I-13)

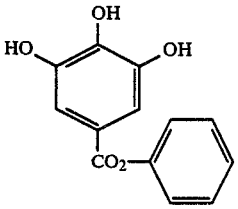

(I-14)

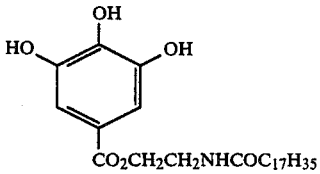

(I-15)

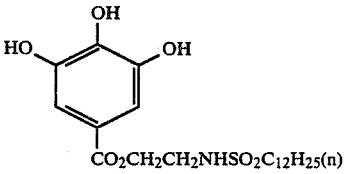

(I-16)

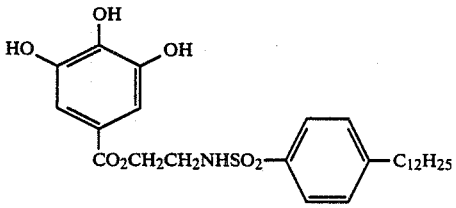

(I-17)

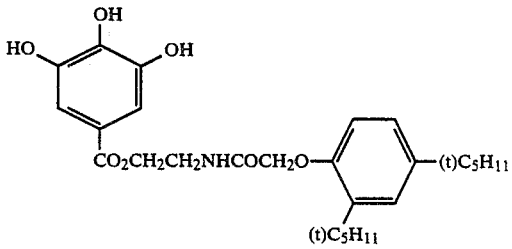

-continued (I-18)

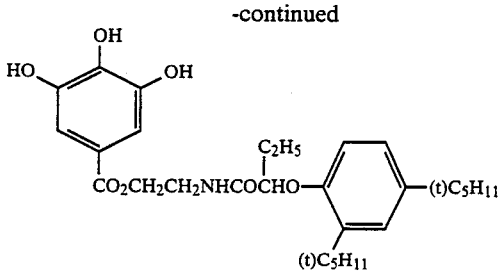

(I-19)

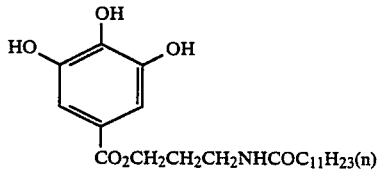

(I-20)

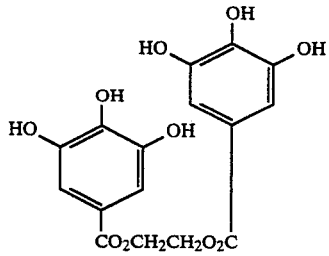

(I-21)

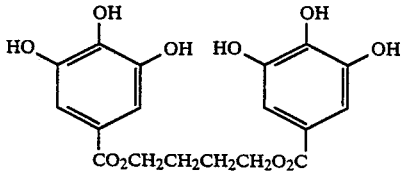

(I-22)

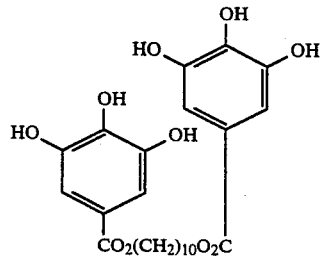

The term "high speed reactive type coupler" which is employed in the present invention means a coupler which quickly undergoes the coupling reaction with the oxidation product of color developing agent. More specifically, the high speed reactive type coupler used in the present invention possesse a relative coupling speed of 0.35 to 1.0, preferably 0.45 to 1.0, more preferably 0.6 to 1.0.

The term "relative coupling speed" is recognized in the art and defined in, for example, U.S. Pat. No. 3,933,501 (Japanese Patent Application (OPI) 53944/82). The relative coupling speed as used herein is measured by the following method which improves the measurement method described in the U.S. patent supra. Namely, a coated material having a formulation described below was exposed to light through a step wedge. Thereafter, the exposed material was subjected to Development Processings B and C described below. Then, an amount of developed silver was measured by fluorescent x rays. The thus processed material was then subjected to Processing C to remove silver. Thereafter, the resulting color density was measured. The amount of developed silver was plotted to the color density and, a ratio in slope of a straight line obtained by the system wherein citrazinic acid was present to a straight line obtained by the citrazinic acid-free system was determined and made a relative coupling rate.

Formulation of Coated Material:

Onto a cellulose triacetate film were coated a first layer and a second layer below.

First Layer:

Silver bromoiodie emulsion (iodine content 4 mol%), silver content 1.0 g/m$^2$;

Gelatin dispersion containing coupler, coupler content, 0.1 mol/m$^2$;

Coated amount of gelatin 1.5 g/m$^2$

Second Layer:

Gelatin layer containing trimethyl methacrylate particles, coated amount of gelatin 1.0 g/m$^2$ Development Processing Steps (38° C.):

A: color development (containing no citrazinic acid) for 2 minutes and 10 seconds→water washing for 3 minutes→fixing for 6 minutes→water washing for 3 minutes B: color development (containing 6 g/l of citrazinic acid as a competing coupler) for 2 minutes and 10 seconds→water washing for 3 minutes→fixing for 6 minutes→water washing for 3 minutes C: bleaching for 6 minutes→water washing for 3 minutes→fixing for 6 minutes→water washing for 3 minutes Note: The processing solutions used above have the same compositions as used in Example 1 described hereinafter, except that the color developer used in Processing B contains citrazinic acid in the given amount.

The high speed reactive type coupler includes, for example, those represented by the general formulae (II) to (VI) described hereinbelow.

Among these couplers, couplers represented by the general formulae (II), (V) and (VI) are more preferably used as the high speed reactive type couplers.

(II)

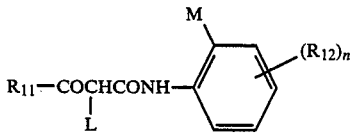

(III)

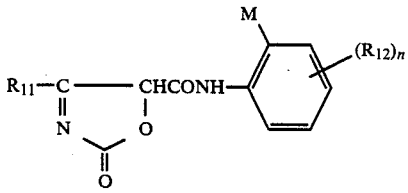

(IV)

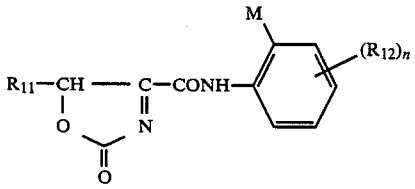

In the general formulae (II), (III) and (IV) above, $R_{11}$ represents an alkyl group or an aryl group, each of which may be substituted; $R_{12}$ represents a substituent which can be substituted for a hydrogen atom attached to the benzene ring; n represents an integer of 1 or 2, and when n is 2, two substituents represented by $R_{12}$ may be the same or different; M represents a halogen atom, an alkoxy group or an aryloxy group; and L represents a group capable of being released from the coupler upon the formation of a dye through the oxidative coupling with an aromatic primary amine developing agent.

More specifically, preferred examples of the alkyl group represented by $R_{11}$ include those having from 1 to 8 carbon atoms. Among these groups, those which have a branched chain, for example, an isopropyl group, a tert-butyl group, a tert-amyl group and the like, are preferable. A tert-butyl group is particularly advantageous. Preferred examples of the aryl group represented by $R_{11}$ include a phenyl group and the like.

Substituents of the alkyl group and the aryl group represented by $R_{11}$ are not limited to any particular ones. However, preferred examples of the substituents include a halogen atom (for example, a fluorine atom, a chlorine atom, a bromine atom, an iodine atom, etc.), an alkyl group (for example, a methyl group, an ethyl group, a t-butyl group, etc.), an aryl group (for example, a phenyl group, a naphthyl group, etc.), an alkoxy group (for example, a methoxy group, an ethoxy group, etc.), an aryloxy group (for example, a phenoxy group, etc.), an alkylthio group (for example, a methylthio, an ethylthio group, an octylthio group, etc.), an arylthio group (for example, a phenylthio group, etc.), an acylamino group (for example, an acetamido group, a butyramido group, a benzamido group, etc.), a carbamoyl group (for example, an N-methylcarbamoyl group, an N-phenylcarbamoyl group, etc.), an acyl group (for example, an acetyl group, a benzoyl group, etc.), a sulfonamido group (for example, a methanesulfonamido group, a benzenesulfonamido group, etc.), a sulfamoyl group, a nitrile group, an acyloxy group (for example, an acetoxy group, a benzoyloxy group, etc.), an alkyloxycarbonyl group (for example, a methyloxycarbonyl group, etc.) and the like.

Preferred examples of $R_{12}$ include a halogen atom (for example, a fluorine atom, a chlorine atom, a bromine atom, an iodine atom, etc.),

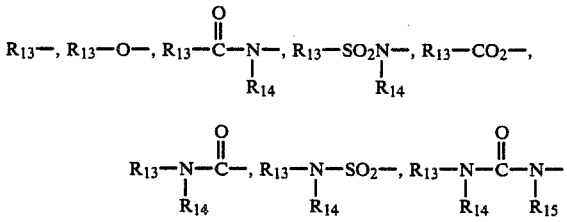

and the like. Therein, $R_{13}$, $R_{14}$ and $R_{15}$, which may be the same or different, each represents a hydrogen atom, an alkyl group, an aryl group or a heterocyclic residue, which groups may be substituted. Preferred examples of them include an alkyl group and an aryl group which may be substituted. Preferred examples of the substituents for $R_{13}$, $R_{14}$ and $R_{15}$ include the same substituents as described in $R_{11}$.

Preferred examples of the halogen atom represented by M include a fluorine atom, a chlorine atom, a bromine atom and an iodine atom. Among such atoms, a fluorine atom and a chlorine atom are more preferable. Preferred examples of the alkoxy group represented by M include those having from 1 to 18 carbon atoms, for example, a methoxy group, an ethoxy group, a cetyloxy, etc. In such groups, a methoxy group is particularly preferred. Preferred examples of the aryloxy group represented by M include a phenoxy group, a naphthyloxy group, etc.

Preferred examples of the group represented by L include a halogen atom (for example, a fluorine atom, a chlorine atom, a bromine atom, etc.), —$SR_{16}$ group [wherein $R_{16}$ represents an alkyl group (for example, a methyl group, an ethyl group, an ethoxyethyl group, an ethoxycarbonylmethyl group, etc.), an aryl group (for example, a phenyl group, a 2-methoxyphenyl group, etc.), a heterocyclic residue (for example, a benzoxazolyl group, a 1-phenyl-5-tetrazolyl group, etc.) or an acyl group (for example, an ethoxycarbonyl, etc.)], —$OR_{17}$ group [wherein $R_{17}$ represents an alkyl group (for example, a carboxymethyl group, an N-(2-methoxyethyl)carbamoylmethyl group, etc.), an aryl group (for example, a phenyl group, a 4-carboxyphenyl group, a 4-(4-benzyloxybenzenesulfonyl)phenyl group, etc.), a heterocyclic residue (for example, a 1-phenyl-5-tetrazolyl group, an isoxazolyl group, a 4-pyridyl group, etc.) or an acyl group (for example, an ethoxycarbonyl group, an N,N-diethylcarbamoyl group, a phenylsulfamoyl group, an N-phenylthiocarbamoyl group, etc.)] and

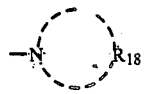

group (wherein $R_{18}$ represents a non-metallic atomic group necessary to form a 5- or 6-membered ring together with —N<, and constituent atoms of such a ring preferably include C, N, O and/or S and, further, such a ring may have an appropriate substituent).

Preferred examples of the heterocyclic residue represented by

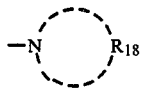

are illustrated below.

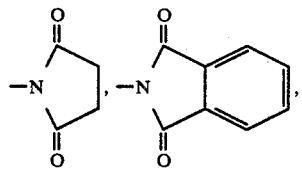

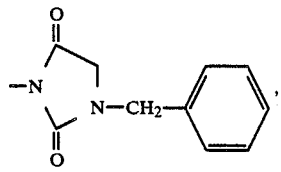

-continued

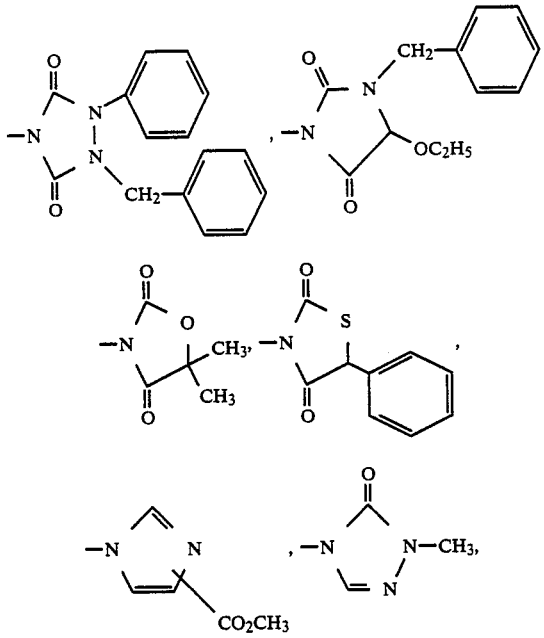

-continued

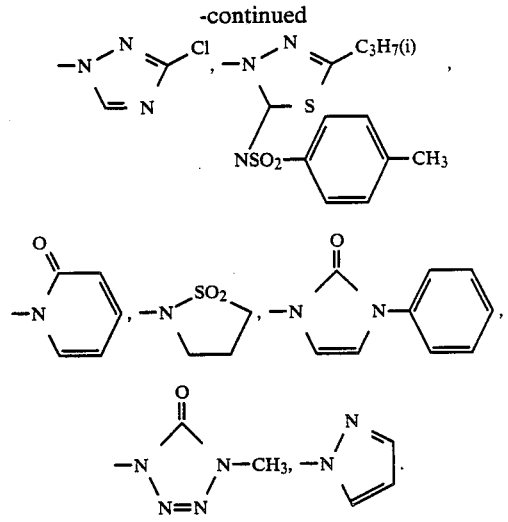

Preferred examples of the high speed reactive type couplers represented by the general formulae (II) to (IV) are illustrative below. However, the high speed reactive type couplers which can be employed in the present invention should not be construed as being limited to the following examples as long as the couplers meet the relative coupling speed requirement described above.

II-1

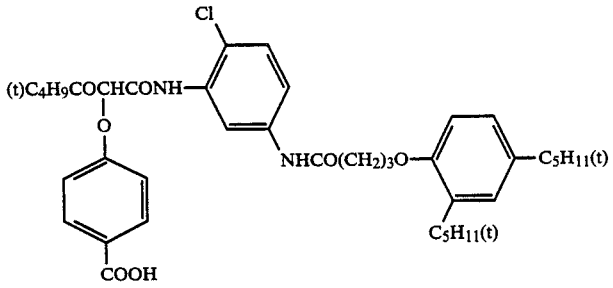

II-2

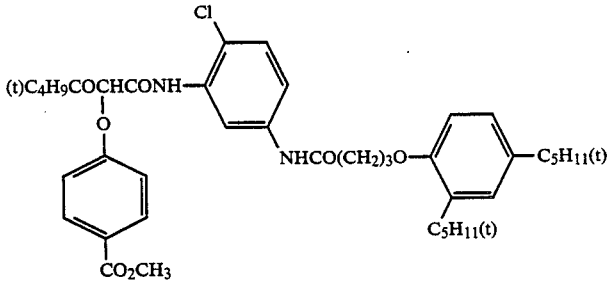

II-3

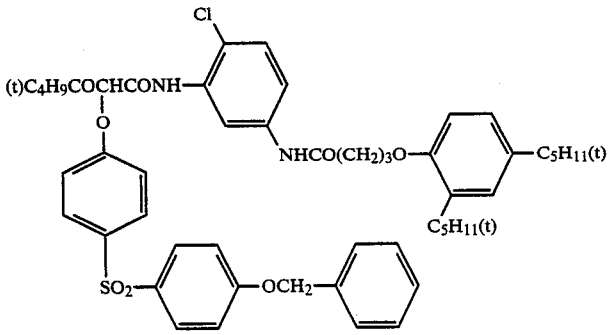

-continued
II-4
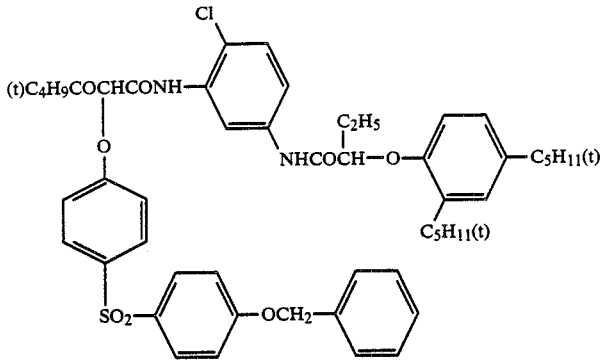
II-5
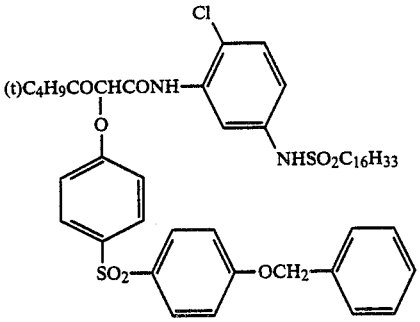
II-6
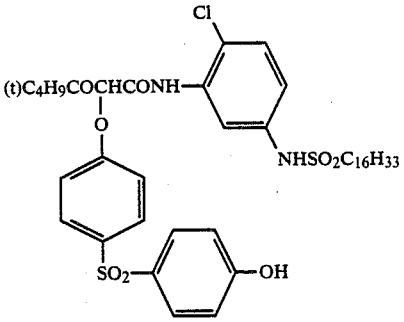
II-7
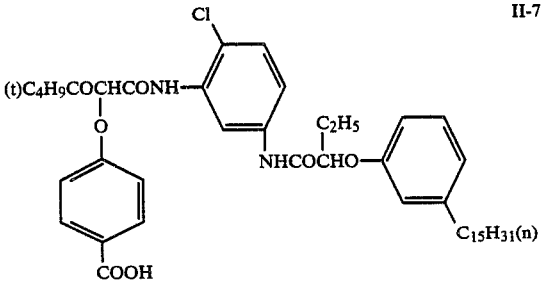
II-8
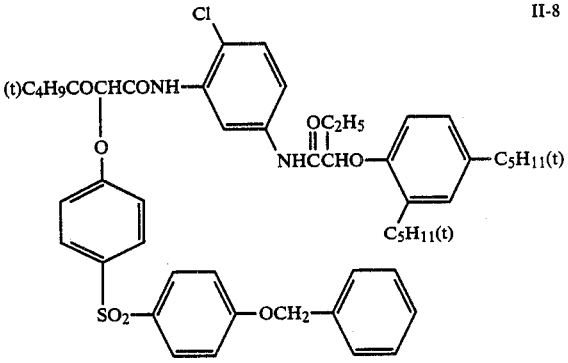
II-9
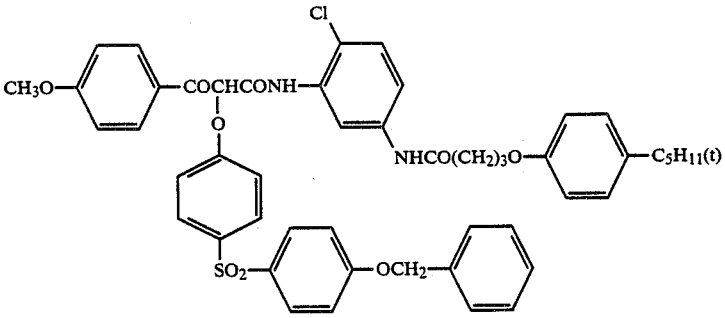
II-10
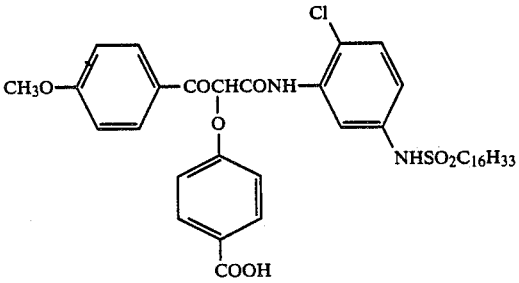

-continued
II-11
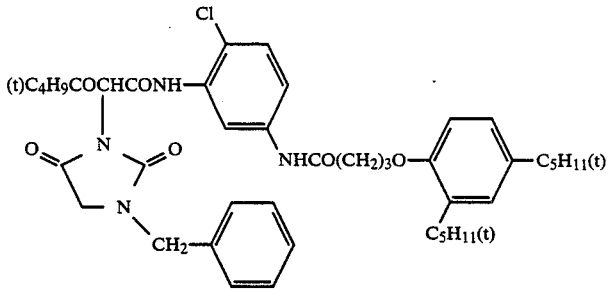
II-12
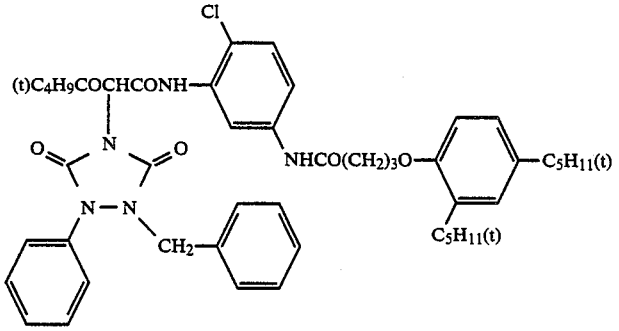
II-13
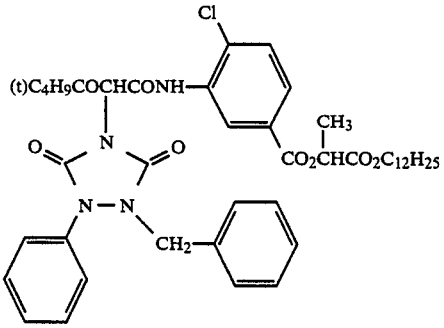
II-14
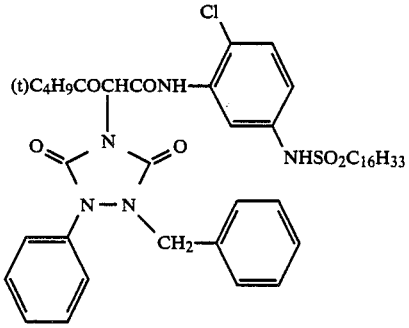
II-15
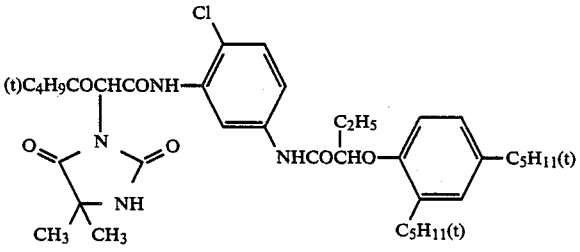
II-16
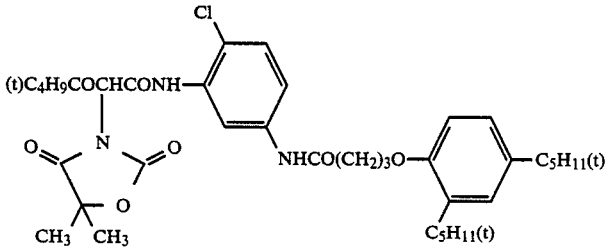

-continued
II-17
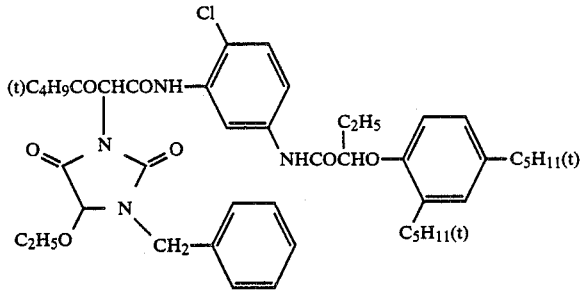
II-18
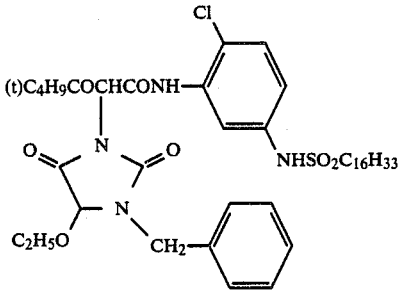
II-19
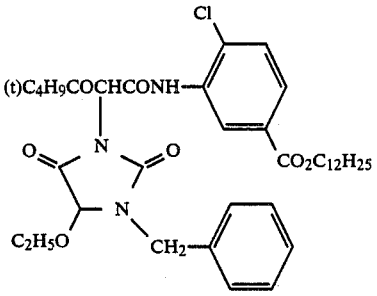
II-20
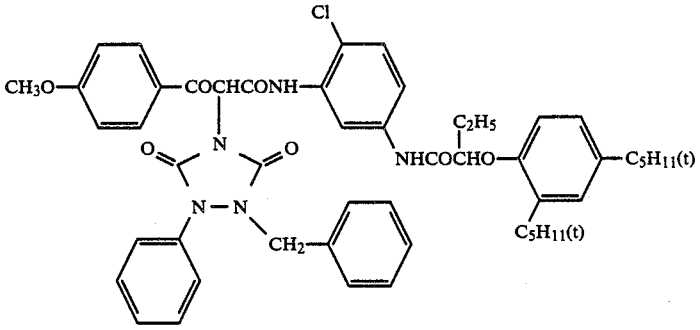
II-21
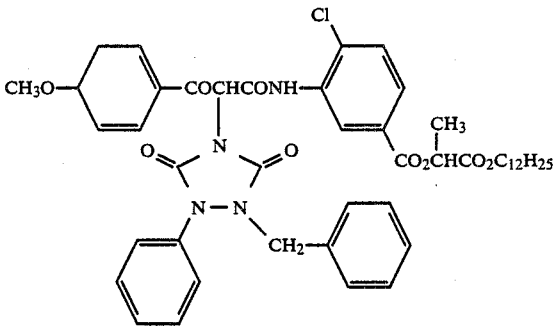
II-22
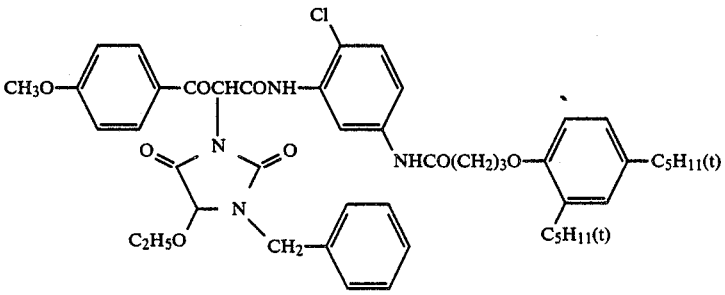

-continued
II-23
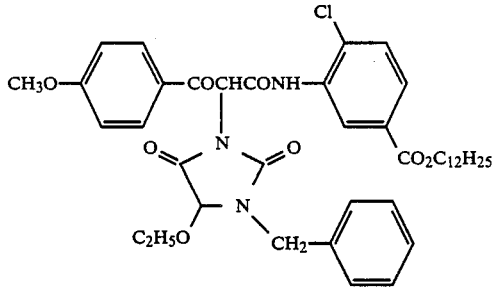
II-24
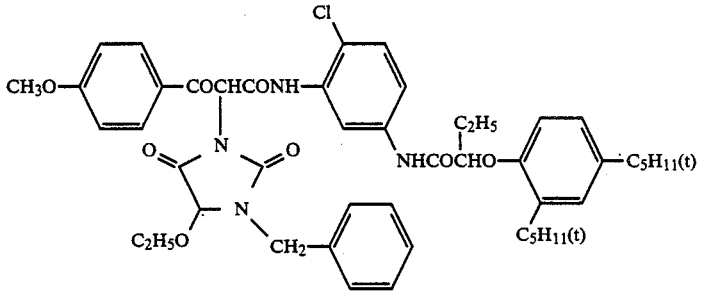
II-25
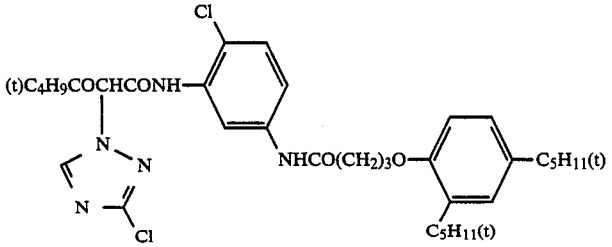
II-26
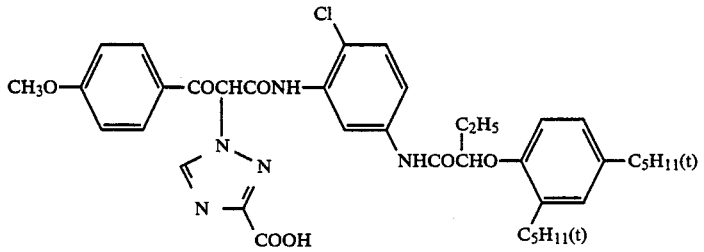
II-27
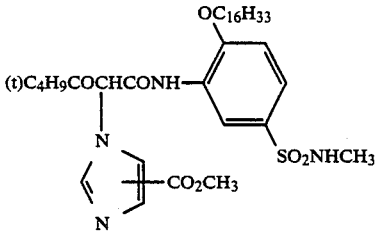
II-28
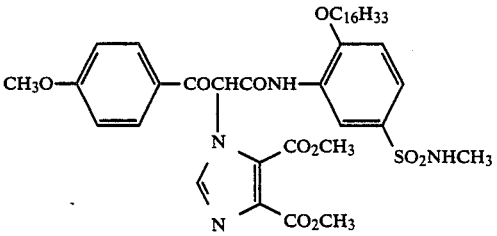
II-29
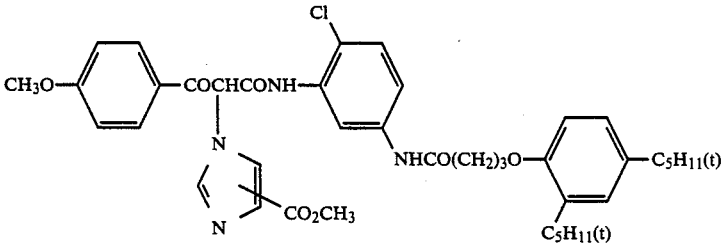

-continued
II-30
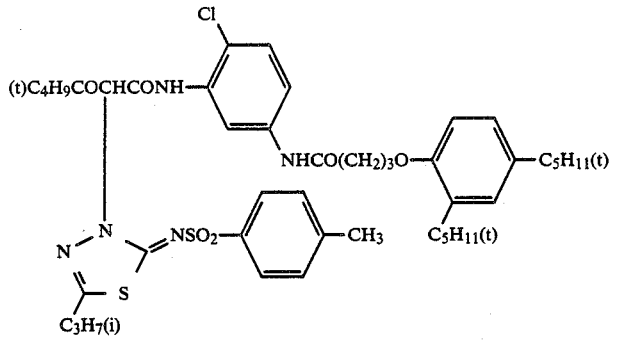
II-31
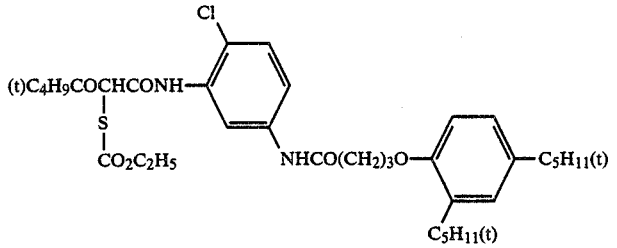
II-32
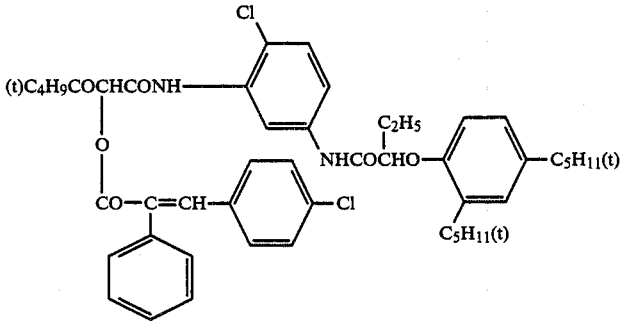
II-33
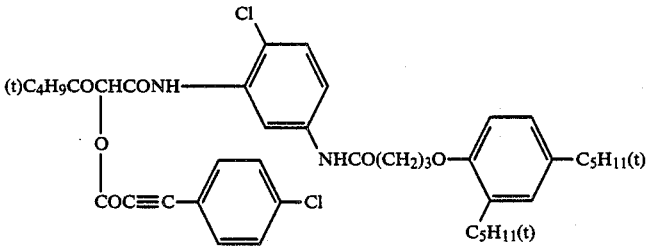
II-34
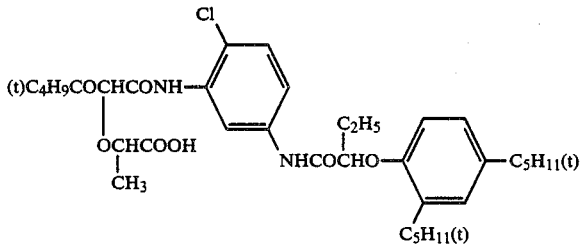

-continued

II-35

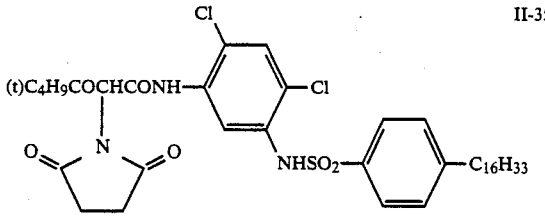

II-36

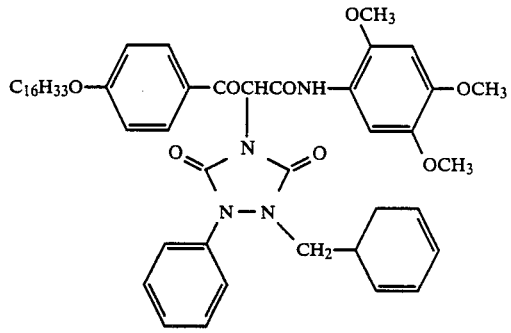

II-37

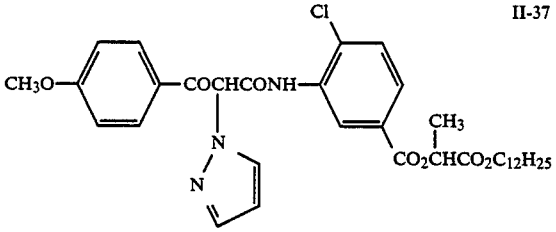

III-1

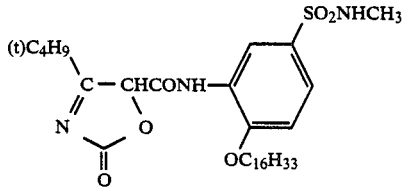

III-2

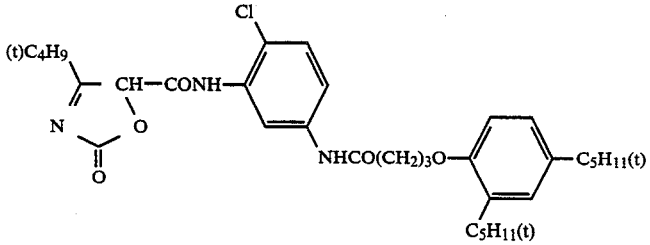

III-3

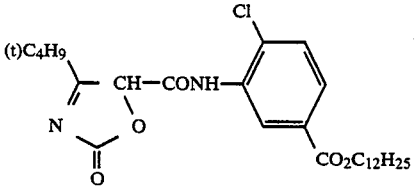

III-4

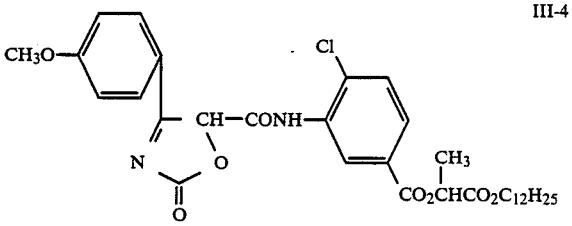

IV-1

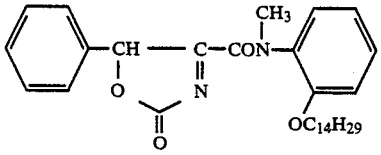

(V)

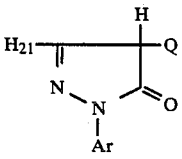

In the general formula (V) above, $R_{21}$ represents an amino group, an acylamino group or a ureido group; Q represents a group capable of being released from the coupler (V) upon the formation of a dye through the oxidative coupling with an aromatic primary amine developing agent; and Ar represents a phenyl group which may be substituted with one or more substituents, with preferred examples of the substituents including a halogen atom, an alkyl group, an alkoxy group, an aryloxy group, an alkoxycarbonyl group, a cyano group, a carbamoyl group, a sulfamoyl group, a sulfonyl group and an acylamino group.

More specifically, preferred examples of the amino group represented by $R_{21}$ include an anilino group, a 2-chloroanilino group, a 2,4-dichloroanilino group, a 2,5-dichloroanilino, a 2,4,5-trichloroanilino group, a 2-chloro-5-tetradecanamidoanilino group, a 2-chloro-5-(3-octadecenylsuccinimido)anilino group, a 2-chloro-5-tetradecyloxycarbonylanilino group, a 2-chloro-5-(N-tetradecylsulfamoyl)anilino group, a 2,4-dichloro-5-tetradecyloxyanilino group, 2-chloro-5-(tetradecyloxycarbonylamino)anilino group, a 2-chloro-5-octadecylthioanilino group, a 2-chloro-5-(N-tetradecylcarbamoyl-)anilino group, a 2-chloro-5-[α-(3-tert-butyl-4-hydroxy)tetradecanamido]anilino group, a dimethylamino group, a diethylamino group, a dioctylamino group, a pyrrolidino group and so on.

Preferred examples of the acylamino group represented by $R_{21}$ include an acetamido group, a benzamido group, a 3-[α-(2,4-di-tert-amylphenoxy)butanamido]-benzamido group, a 3-[α-(2,4-di-tert-amylphenoxy)acetamido]benzamido group, a 3-[α-(3-pentadecylphenoxy)butanamido]benzamido group, a α-(2,4-di-tert-amylphenoxy)butanamido group, an α-(3-pentadecylphenoxy)butanamido group, a hexadecanamido group, an isostearoylamino group, a 3-(3-octadecenylsuccinimido)benzamido group, a pivaloylamino group and so on.

Preferred examples of the ureido group represented by $R_{21}$ include a 3-[(2,4-di-tert-amylphenoxy)acetamido]phenylureido group, a phenylureido group, a methylureido group, an octadecylureido group, a 3-tetradecanamidophenylureido group, an N,N-dioctylureido group and so on.

Particularly preferred $R_{21}$ is an amino group; of the amino group, a substituted anilino group is most preferred.

Preferred examples of the group represented by Q in the general formula (V) include $R_{22}CONH$— (for example, $CF_3CONH$—, $Cl_3CCONH$—, etc.), $R_{22}O$— (for example,

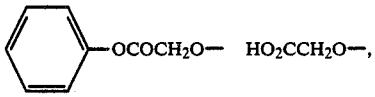

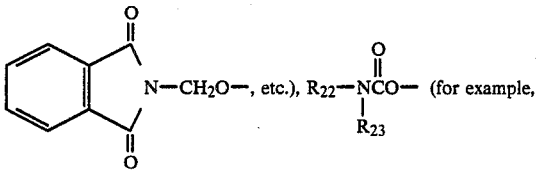

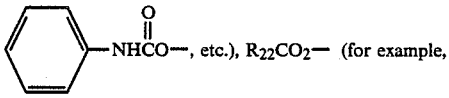

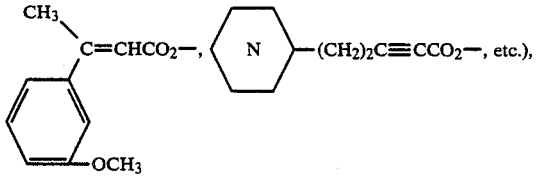

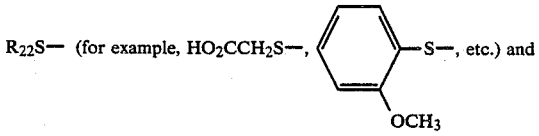

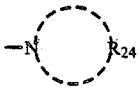

(wherein $R_{24}$ represents a non-metallic atomic group necessary to form a 5- or 6-membered ring together with —N<, and constituent atoms of such a ring preferably include C, N, O and/or S and further such a ring may have an appropriate substituent).

Preferred examples of the heterocyclic residue represented by

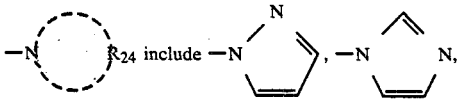

-continued

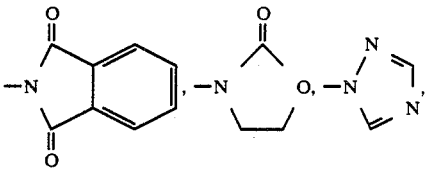

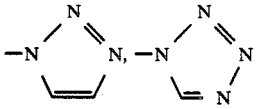

and so on. Preferred examples of the substituent which may be attached to the heterocyclic residues include an alkyl group, an alkenyl group, an alicyclic hydrocarbon residue, an aralkyl group, an aryl group, a heterocyclic residue, an alkoxy group, an alkoxycarbonyl group, an aryloxy group, an alkylthio group, a carboxy group, an acylamino group, a diacylamino group, a ureido group, an alkoxycarbonylamino group, an amino group, an acyl group, a sulfonamido group, a carbamoyl group, a sulfamoyl group, a cyano group, an acyloxy group, a sulfonyl group, a halogen atom, a sulfo group and so on.

Therein, $R_{22}$ and $R_{23}$ may be the same or different, and they each represent an aliphatic group, an aromatic group or a heterocyclic residue. $R_{22}$ and $R_{23}$ may be substituted with an appropriate substituent, and $R_{23}$ may be a hydrogen atom.

The aliphatic group represented by $R_{22}$ or $R_{23}$ includes a straight chain or branched chain alkyl group, an alkenyl group, an alkynyl group and an alicyclic hydrocarbon group.

Preferred examples of the alkyl group represented by $R_{22}$ or $R_{23}$ include those having from 1 to 32 carbon atoms, preferably from 1 to 20 carbon atoms, for example, a methyl group, an ethyl group, a propyl group, a butyl group, an octyl group, an octadecyl group, an isopropyl group and so on. Preferred examples of the alkenyl group represented by $R_{22}$ or $R_{23}$ include those having from 2 to 32 carbon atoms, preferably from 3 to 20 carbon atoms, for example, an allyl group, a butenyl group and so on. Preferred examples of the alkynyl group represented by $R_{22}$ or $R_{23}$ include those having from 2 to 32 carbon atoms, preferably from 2 to 20 carbon atoms, for example, an ethynyl group, a propargyl group and so on. Preferred examples of the alicyclic hydrocarbon group represented by $R_{22}$ or $R_{23}$ include those having from 3 to 32 carbon atoms, preferably from 5 to 20 carbon atoms, for example, a cyclopentyl group, a cyclohexyl group, a 10-camphanyl group and so on.

Preferred examples of the aromatic group represented by $R_{22}$ or $R_{23}$ include a phenyl group, a naphthyl group and son on.

The heterocyclic group represented by $R_{22}$ or $R_{23}$ is a 5- or 6-membered ring residue which is constituted with a carbon atom and at least one hetero atom selected from the group consisting of a nitrogen atom, an oxygen atom and a sulfur atom and, further, may be condensed with a benzene ring, with preferred examples include a pyridyl group, pyrrolyl group, a pyrazolyl group, a triazolyl group, a triazolidyl group, an imidazolyl group, a tetrazolyl group, a thiazolyl group, an oxazolyl group, a thiadiazolyl group, an oxadiazolyl group, a quinolinyl group, a benzothiazolyl group, a benzoxazolyl group, a benzimidazolyl group and so on.

Preferred examples of the substituents for the groups represented by $R_{22}$ or $R_{23}$ include an alkyl group (for example, a methyl group, an ethyl group, a t-octyl group, etc.), an aryl group (for example, a phenyl group, a naphthyl group, etc.), a nitro group, a hydroxy group, a cyano group, a sulfo group, an alkoxy group (for example, a methoxy group, an ethoxy group, a butyloxy group, a methoxyethoxy group, etc.), an aryloxy group (for example, a phenoxy group, a naphthyloxy group, etc.), a carboxy group, an acyloxy group (for example, an acetoxy group, a benzoyloxy group, etc.), an acylamino group (for example, an acetylamino group, an benzoylamino group, etc.), a sulfonamido group (for example, a methanesulfonamido group, a benzenesulfonamido group, etc.), a sulfamoyl group (for example, a methylsulfamoyl group, a phenylsulfamoyl group, etc.), a halogen atom (for example, a fluorine atom, a chlorine atom, a bromine atom, etc.), a carbamoyl group (for example, an N-methylcarbamoyl group, an N-2-methoxyethylcarbamoyl group, an N-phenylcarbamoyl group, etc.), an alkoxycarbonyl group (for example, a methoxycarbonyl group, an ethoxycarbonyl group, etc.), an acyl group (for example, an acetyl group, a benzoyl group, etc.), a sulfonyl group (for example, a methylsulfonyl group, a phenylsulfonyl group, etc.), a sulfinyl group (for example, a methylsulfinyl group, a phenylsulfinyl group, etc.), a heterocyclic group (for example, a morpholino group, a pyrazolyl group, a triazolyl group, a tetrazolyl group, an imidazolyl group, a pyridyl group, a benzotriazolyl group, a benzimidazolyl group, etc.), an amino group (for example, an unsubstituted amino group, a methylamino group, an ethylamino group, etc.), an alkylthio group (for example, a methylthio group, an ethylthio group, a carboxymethylthio group, etc.), an arylthio group (for example, a phenylthio group, etc.) and so on. These substituents may be further substituted with one of the above described substituents.

Preferred examples of the high speed reactive type couples represented by the general formula (V) are illustrated below. However, the high speed reactive type couplers which can be employed in the present invention should not be construed as being limited to the following examples.

V-1

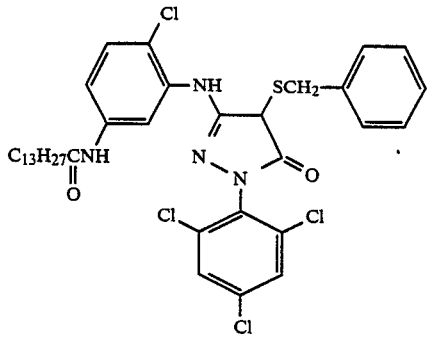

V-2

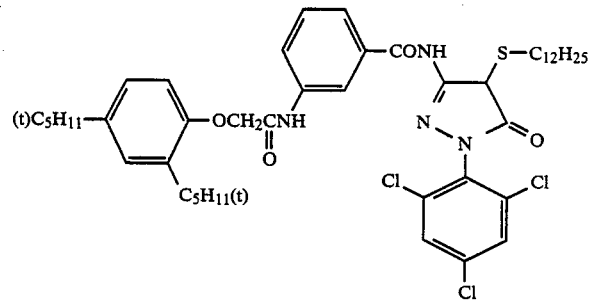

V-3

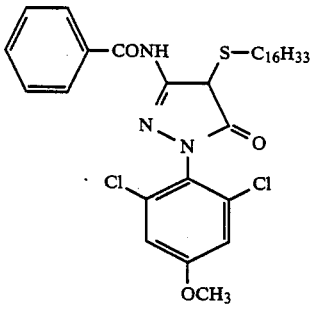

V-4

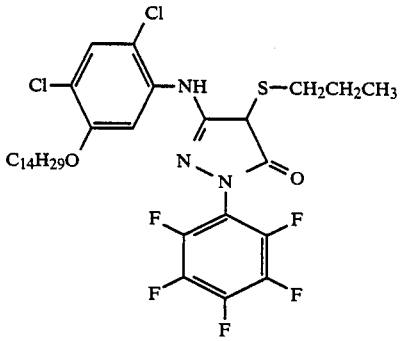

V-5

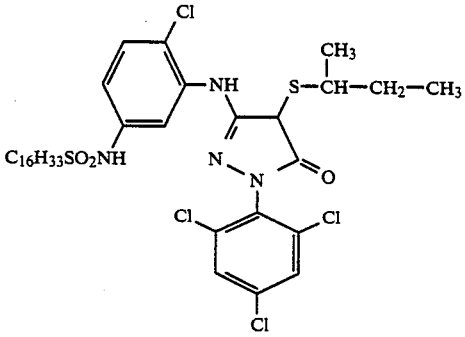

V-6

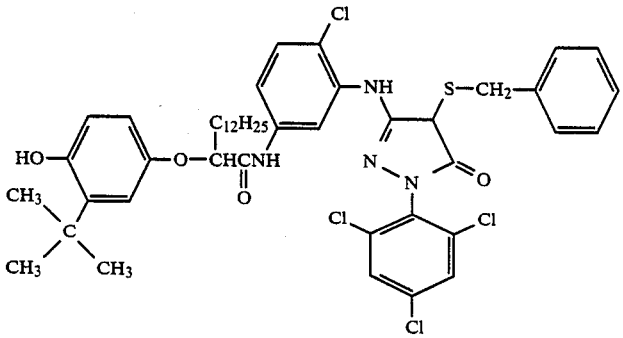

-continued
V-7
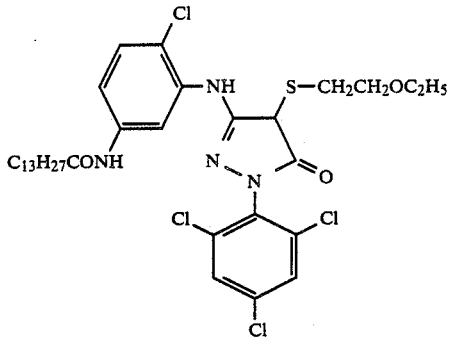
V-8
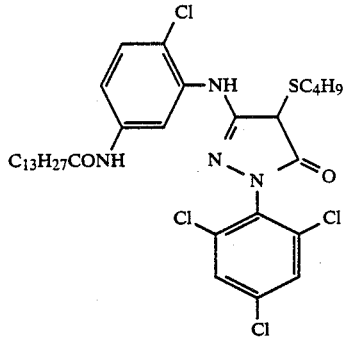
V-9
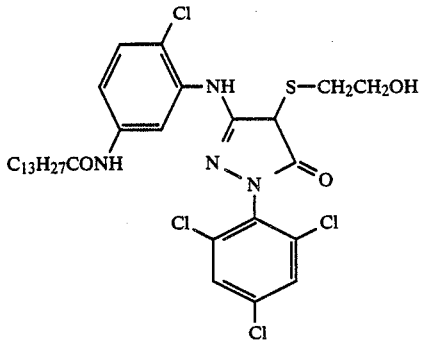
V-10
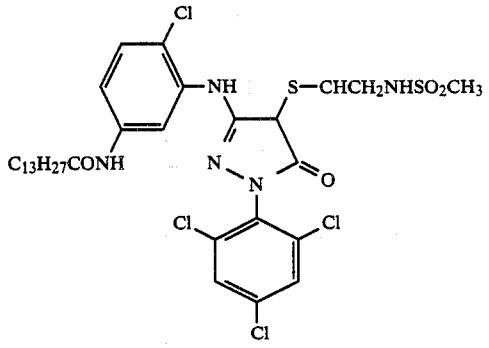
V-11
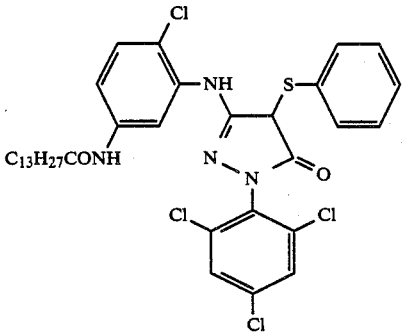
V-12
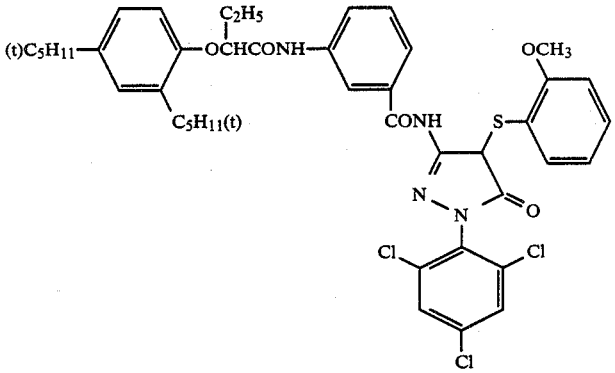
V-13
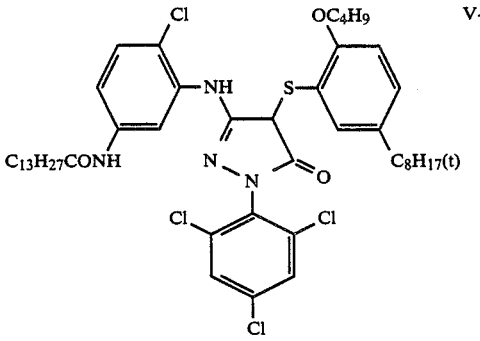
V-14
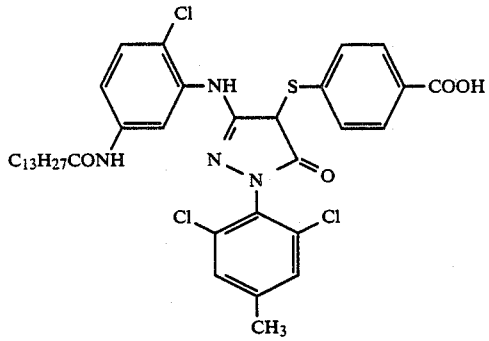

-continued
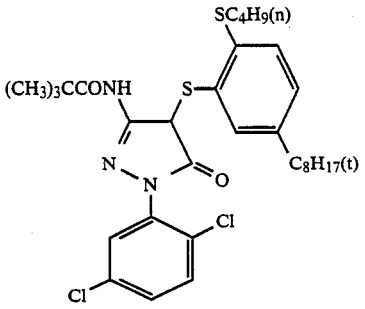
V-15
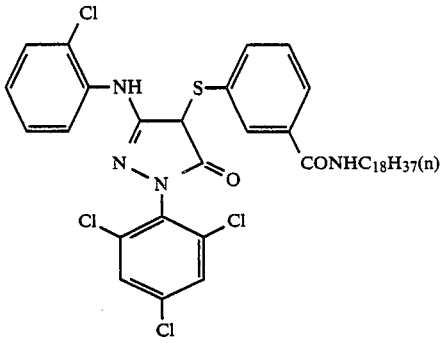
V-16
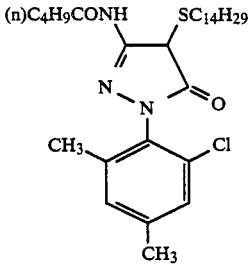
V-17
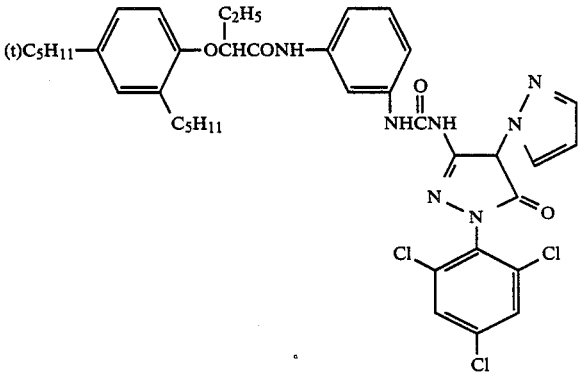
V-18
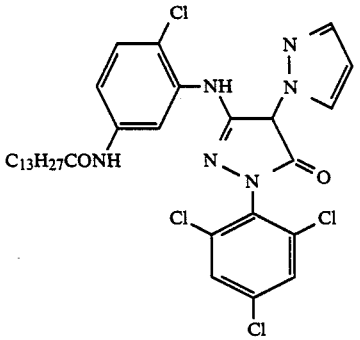
V-19
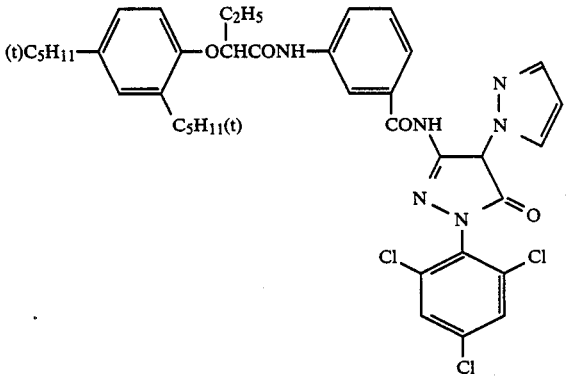
V-20
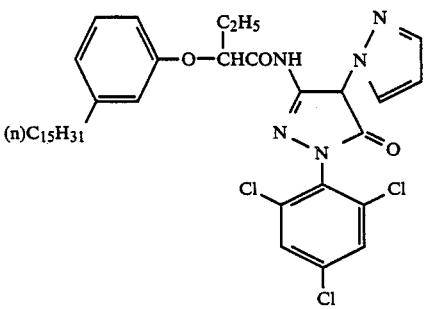
V-21
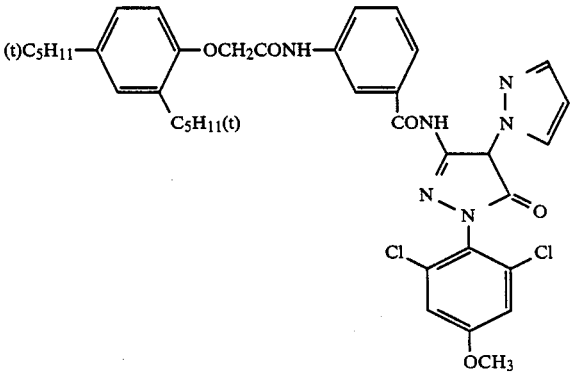
V-22

-continued
V-23
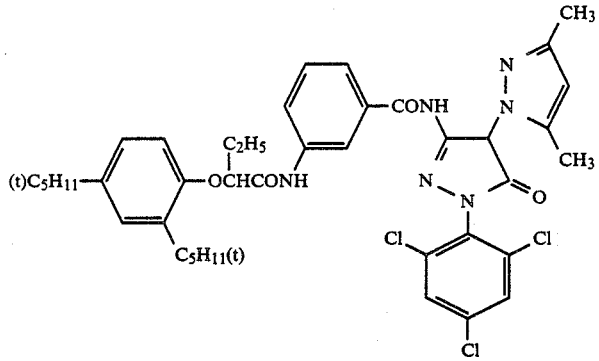
V-24
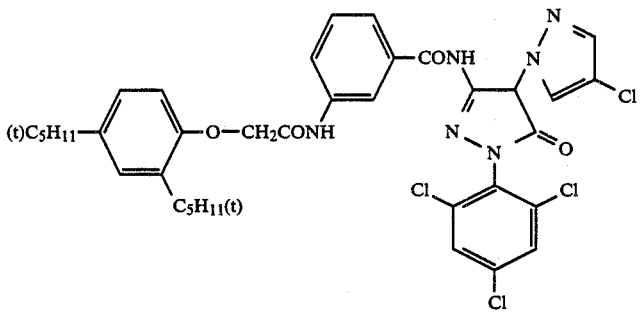
V-25
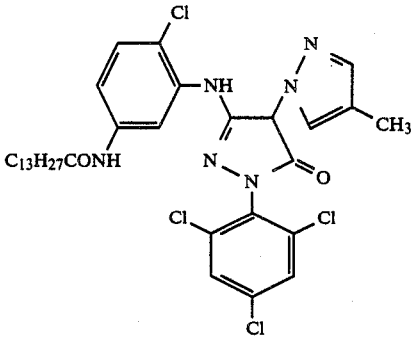
V-26
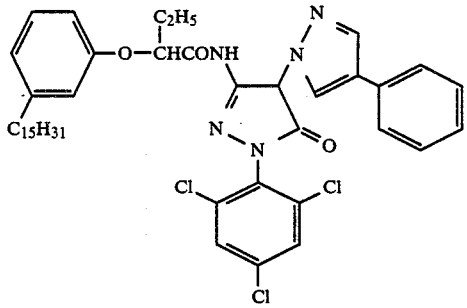
V-27
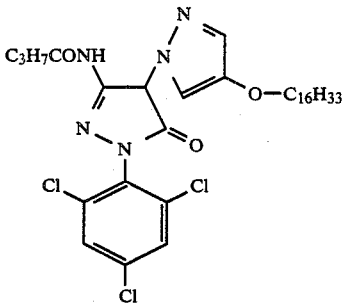
V-28
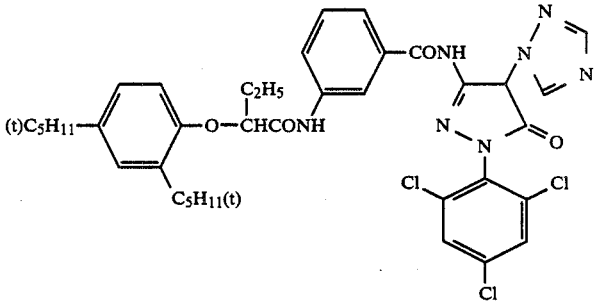
V-29
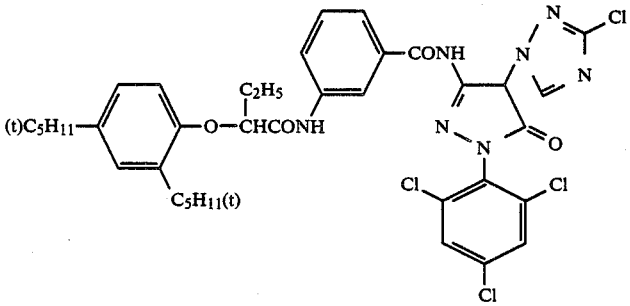

-continued
V-30
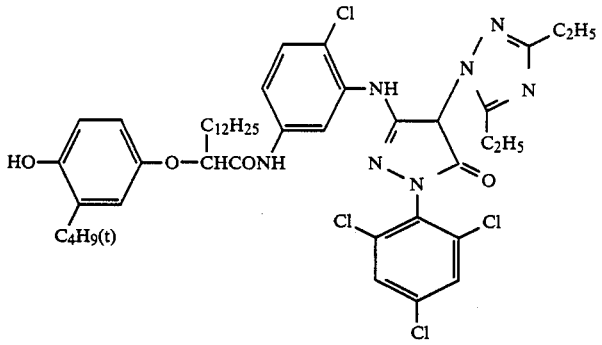
V-31
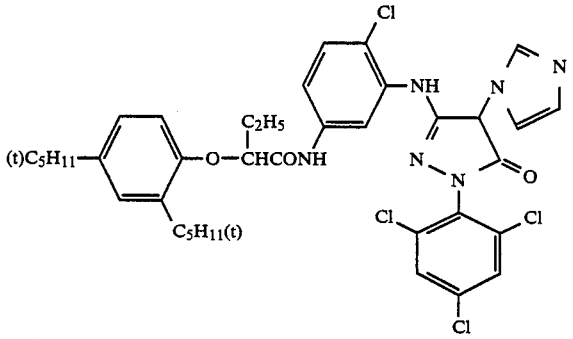
V-32
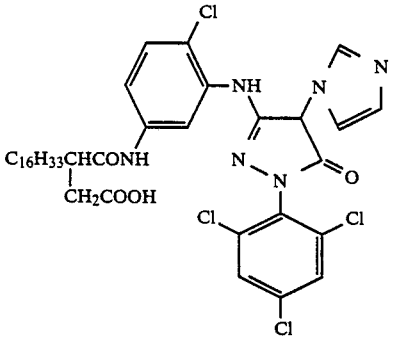
V-33
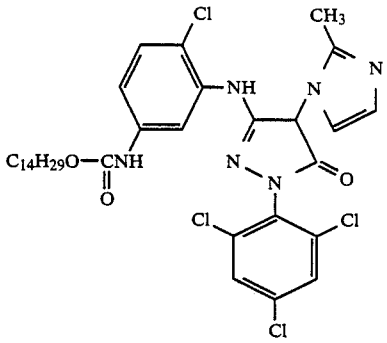
V-34
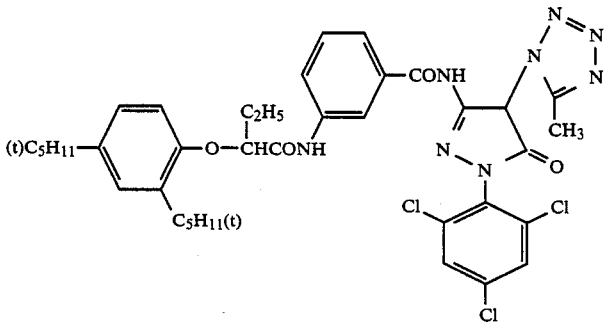

-continued
V-35
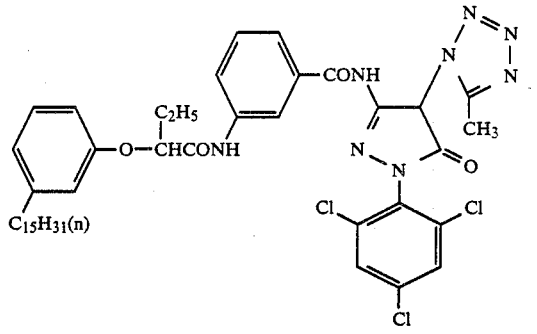
V-36
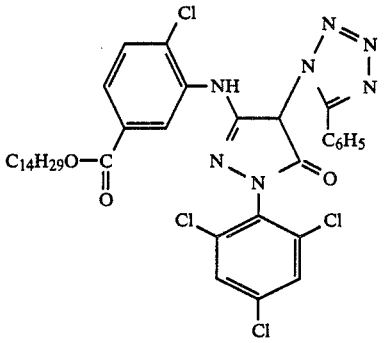
V-37
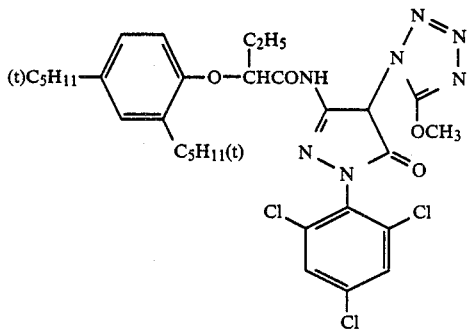
V-38
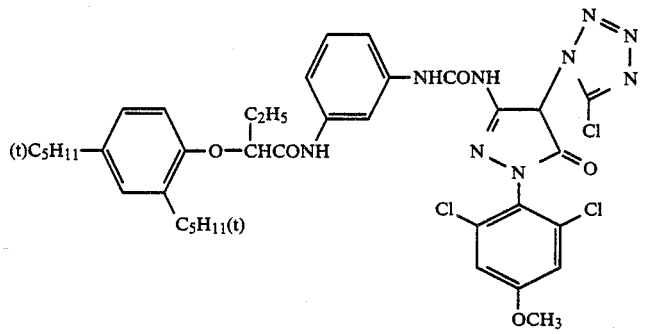
V-39
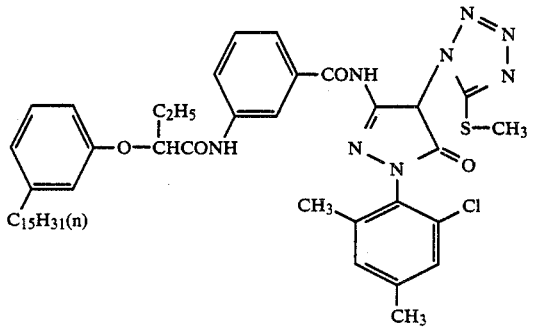

-continued
V-40
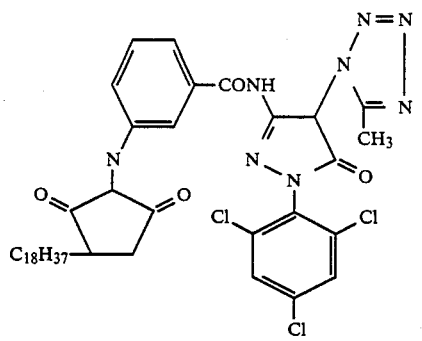
V-41
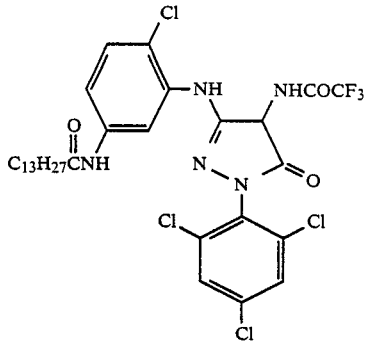
V-42
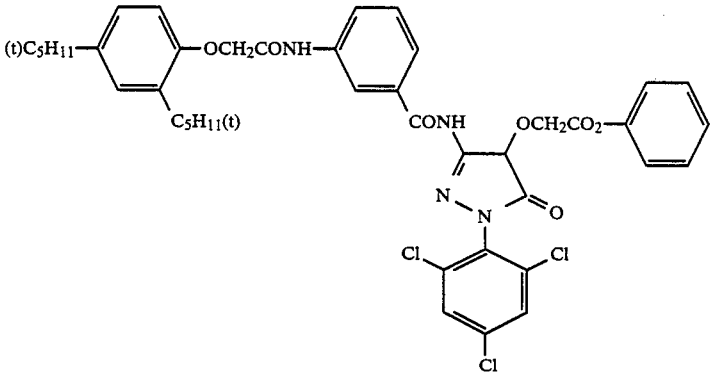
V-43
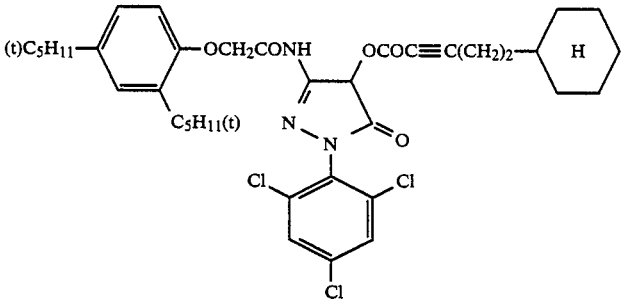
V-44
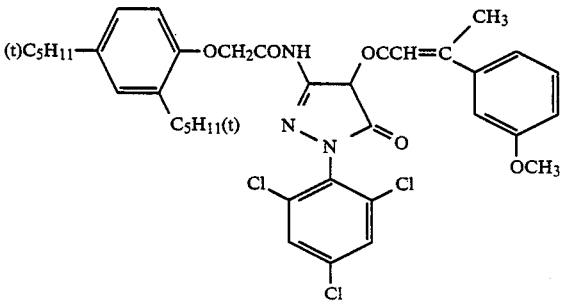

-continued

V-45

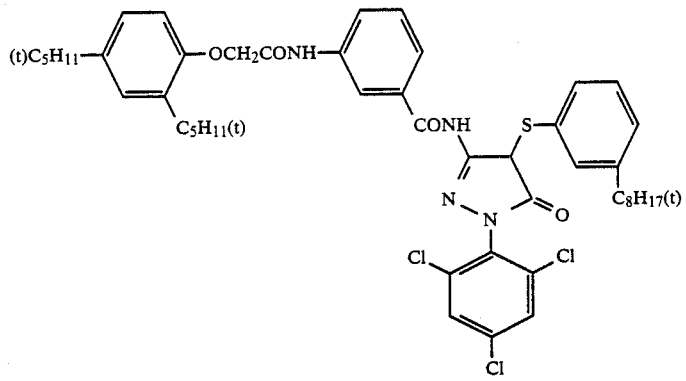

$(A)_m Z$ (VI)

In the general formula (VI) above, A represents an image forming coupler residue which has a naphthol nucleus or a phenol nucleus; m represents 1 or 2; and Z represents a group which is attached to the coupling position of the above-described coupler residue and capable of being released from the coupler (VI) upon the formation of dye through the oxidative coupling with an aromatic primary amine developing agent, with preferred examples including a halogen atom (for example, a fluorine atom, a chlorine atom, etc.), $—OR_{31}$. Therein, when m represents 2, Z represents the divalent group corresponding to one of the above-described monovalent groups. $R_{31}$ therein each represents an aliphatic group, an aromatic group or a heterocyclic group, which may be substituted with an appropriate substituent.

More specifically, preferred examples of the aliphatic group represented by $R_{31}$ include a straight chain or branched chain alkyl group, an alkenyl group, an alkynyl group and an alicyclic hydrocarbon group.

Preferred examples of the alkyl groups represented by $R_{31}$ include those having from 1 to 32 carbon atoms, preferably from 1 to 20 carbon atoms, for example, a methyl group, an ethyl group, a propyl group, a butyl group, an octyl group, an octadecyl group, an isopropyl group, and so on. Preferred examples of the alkenyl group represented by $R_{31}$ include those having from 2 to 32 carbon atoms, preferably from 3 to 20 carbon atoms, for example, an allyl group, a butenyl group and so on. Preferred examples of the alkynyl group represented by $R_{31}$ include those having from 2 to 32 carbon atoms, preferably from 2 to 20 carbon atoms, for example, an ethynyl group, a propargyl group and so on. Preferred examples of the alicyclic hydrocarbon group represented by $R_{31}$ include those having from 3 to 32 carbon atoms, preferably from 5 to 20 carbon atoms, for example, a cyclopentyl group, a cyclohexyl group, a 10-camphanyl group and so on.

Preferred examples of the aromatic group represented by $R_{31}$ include a phenyl group, a naphthyl group and so on.

The heterocyclic group represented by $R_{31}$ is a 5- or 6-membered ring residue which is constituted with a carbon atom and at least one hetero atom selected from the group consisting of a nitrogen atom, an oxygen atom and a sulfur atom and, further may be condensed with a benzene ring, with preferred examples including a pyridyl group, a pyrrolyl group, a pyrazolyl group, a triazolyl group, a triazolidyl group, an imidazolyl group, a tetrazolyl group, a thiazolyl group, an oxazolyl group, a thiadiazolyl group, an oxadiazolyl group, a quinolinyl group, a benzothiazolyl group, a benzoxazolyl group, a benzimidazolyl group and so on.

Preferred examples of the substituents for the groups represented by $R_{31}$ include an aryl group (for example, a phenyl group, a naphthyl group, etc.), a nitro group, a hydroxyl group, a cyano group, a sulfo group, an alkoxy group (for example, a methoxy group, an ethoxy group, a methoxyethoxy group, etc.), an aryloxy group (for example, a phenoxy group, a naphthyloxy group, etc.), a carboxy group, an acyloxy group (for example, an acetoxy group, a benzoyloxy group, etc.), an acylamino group (for example, an acetylamino group, a benzoylamino group, etc.), a sulfonamido group (for example, a methanesulfonamido group, a benzenesulfonamido group, etc.), a sulfamoyl group (for example, a methylsulfamoyl group, a phenylsulfamoyl group, etc.), a halogen atom (for example, a fluorine atom, a chlorine atom, a bromine atom, etc.), a carbamoyl group (for example, an N-methylcarbamoyl group, an N-2-methoxyethylcarbamoyl group, an N-phenylcarbamoyl group, etc.), an alkoxycarbonyl group (for example, a methoxycarbonyl group, an ethoxycarbonyl group, etc.), an acyl group (for example, an acetyl group, a benzoyl group, etc.), a sulfonyl group (for example, a methylsulfonyl group, a phenylsulfonyl group, etc.), a sulfinyl group (for example, a methylsulfinyl group, a phenylsulfinyl group, etc.), a heterocyclic group (for example, a morpholino group, a pyrazolyl group, a triazolyl group, a tetrazolyl group, an imidazolyl group, a pyridyl group, a benzotriazolyl group, a benzimidazolyl group, etc.), an amino group (for example, an unsubstituted amino group, a methylamino group, an ethylamino group, etc.), an alkylthio group (for example, a methylthio group, an ethylthio group, a carboxymethylthio group, etc.) and an arylthio group (for example, a phenylthio, etc.). These substituents may be further substituted with one of the above-described substituents.

Among the couplers represented by the general formula (VI), those particularly preferred are represented by the following general formula (VII):

$(R_{33}—A_1)_m Z$ (VII)

wherein m represents 1 or 2; $A_1$ represents a cyan image forming coupler residue having a phenol nucleus or a cyan image forming coupler residue having an α-naphthol nucleus; z represents a group which is attached to the coupling position of the above-described coupler residue and capable of being released from the coupler (VII) upon the formation of dye through the oxidative coupling with an aromatic primary amine developing agent, that is, the group having the same meaning as defined in the general formula (VI) above; and $R_{33}$ represents a hydrogen atom; an alkyl group having 30 or less carbon atoms, preferably from 1 to 20 carbon atoms, for example, a methyl group, an isopropyl group, a pentadecyl group, an eicosyl group and so on; and alkoxy group having 30 or less carbon atoms, preferably from 1 to 20 carbon atoms, for example, a methoxy group, an isopropoxy group, a pentadecyloxy group, an eicosyloxy group and so on; an aryloxy group, for example, a phenoxy group, a p-tert-butylphenoxy group and so on, an acylamino group represented by the general formulae (A) to (D) below, respectively; and a carbamyl group represented by the general formulae (E) and (F) below, respectively.

$$-NH-CO-X \quad (A)$$

$$-NH-SO_2-X \quad (B)$$

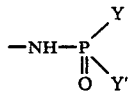
(C)

$$-NHCONH-X \quad (D)$$

$$-CONHX \quad (E)$$

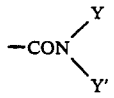
(F)

wherein X represents a straight chain or a branched chain alkyl group having from 1 to 32 carbon atoms, preferably from 1 to 20 carbon atoms, a cyclic alkyl group (for example, a cyclopropyl group, a cyclohexyl group, a norbornyl group, etc.) or an aryl group (for example, a phenyl group, a naphthyl group, etc.). The above-described alkyl group and aryl group may be substituted with a halogen atom, a nitro group, a cyano group, a hydroxyl group, a carboxy group, an amino group (for example, an amino group, an alkylamino group, a dialkylamino group, an anilino group, an N-alkylanilino group, etc.), an aryl group, an alkoxycarbonyl group, an acyloxycarbonyl group, an amido group (for example, an acetamido group, a methanesulfonamido group, etc.), an imido group (for example, a succinimido group, etc.), a carbamoyl group (for example, an N,N-dihexylcarbamoyl group, etc.), a sulfamoyl group (for example, an N,N-diethylsulfamoyl group, etc.), an alkoxy group (for example, an ethoxy group, an octadecyloxy group, etc.), an aryloxy group (for example, a phenoxy group, a p-tert-butylphenoxy group, a 4-hydroxy-3-tert-butylphenoxy group, etc.) and so on. Y andd Y' each represents a group selected from the above-described X, —OX, —NH—X and $-NX_2$. $R_{33}$ may be substituted with a coventionally used substituent in addition to the above-described substituent.

Among the compounds represented by the above-described general formula (VII), particularly preferable compounds are represented by the following general formula (VIII) or (IX):

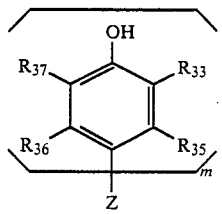
(VIII)

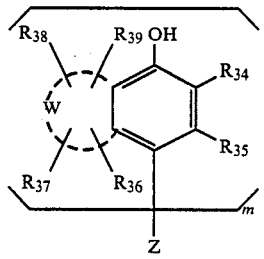
(IX)

wherein m, Z and $R_{33}$ each has the same meaning as defined in the general formula (VII); $R_{34}$ represents a hydrogen atom, an alkyl group having 30 or less carbon atoms, preferably from 1 to 20 carbon atoms, or a carbamoyl group represented by the general formula (E) or (F); $R_{35}$, $R_{36}$, $R_{37}$, $R_{38}$ and $R_{39}$ each represents a hydrogen atom, a halogen atom, an alkyl group, an aryl group, an alkoxy group, an alkylthio group, a heterocyclic group, an amino group, a carbonamido group, a sulfonamido group, a sulfamoyl group or a carbamoyl group; and W represents a non-metallic atomic group necessary to form a 5- or 6-membered ring by ring closing.

More specifically, preferred examples of the group represented by $R_{35}$ include a hydrogen atom; a primary, secondary or tertiary alkyl group having from 1 to 22 carbon atoms, for example, a methyl group, a propyl group, an isopropyl group, a n-butyl group, a sec-butyl group, a tert-butyl group, a hexyl group, a dodecyl group, a 2-chlorobutyl group, a 2-hydroxyethyl group, a 2-phenylethyl group, a 2-(2,4,6-trichlorophenyl)ethyl group, a 2-aminoethyl group, etc.; an aryl group, for example, a phenyl group, a 4-methylphenyl group, a 2,4,6-trichlorophenyl group, a 3,5-dibromophenyl group, a 4-trifluoromethylphenyl group, a 2-trifluoromethylphenyl group, a 3-trifluoromethylphenyl group, a naphthyl group, a 2-chloronaphthyl group, a 3-ethylnaphthyl group, etc.; and a heterocyclic group, for example, a benzofuranyl group, a furyl group, a thiazolyl group, a benzothiazolyl group, a naphthothiazolyl group, an oxazolyl group, a benzoxazolyl group, a naphthoxazolyl group, a pyridyl group, a quinolinyl group, etc. Further, $R_{35}$ may also represent an amino group, for example, an amino group, a methylamino group, a diethylamino group, a dodecylamino group, a phenylamino group, a tolylamino group, a 4-(3-sulfobenzamido)anilino group, a 4-cyanophenylamino group, a 2-trifluoromethylphenylamino group, a benzothiazolamino group, etc.; a carbonamido group, for example, an alkylcarbonamido group such as an ethylcarbonamido group, a decylcarbonamido group, a phenylethylcarbonamido group, etc.; an arylcarbonamido group such as a phenylcarbonamido group, a 2,4,6-trichlorophenylcarbonamido group, a 4-methylphenylcarbonamido group, a 2-ethoxyphenylcarbonamido group, a 3-[α-(2,4-di-tert-amylphenoxy)acetamido]benzamido group, a naphthylcarbonamido group, etc., and a heterocyclic carbonamido group such as a thiazolylcarbonamido group, a benzothiazolylcarbonamido group, a naphthothiazolylcarbonamido group, an oxazolylcarbonamido group, a benzoxazolylcarbonamido group, an imidazolylcarbonamido group, a benzimidazolylcarbonamido group, etc.; a sulfonamido group, for example, an alkylsulfonamido group such as a butylsulfonamido group, a dodecylsulfonamido group, a phenylethylsulfonamido group, etc., an arylsulfonamido group such as a phenylsulfonamido group, a 2,4,6-trichlorophenylsulfonamido group, a 2-methoxyphenylsulfonamido group, a 3-carboxyphenylsulfonamido group, a naphthylsulfonamido group, etc., and a heterocyclic sulfonamido group such as a thiazolylsulfonamido group, a benzothiazolylsulfonamido group, an imidazolylsulfonamido group, a benzimidazolylsulfonamido group, a pyridylsulfonamido group, etc.; a sulfamoyl group, for example, an alkylsulfamoyl group such as a propylsulfamoyl group, an octylsulfamoyl group, a pentadecylsulfamoyl group, an octadecylsulfamoyl group, etc., an arylsulfamoyl group such as a phenylsulfamoyl group, a 2,4,6-trichlorophenylsulfamoyl group, a 2-methoxyphenylsulfamoyl group, a naphthylsulfamoyl group, etc., and a heterocyclic sulfamoyl group such as a thiazolylsulfamoyl group, a benzothiazolylsulfamoyl group, an oxazolylsulfamoyl group, a benzimidazolylsulfamoyl group, a pyridylsulfamoyl group, etc.; and a carbamoyl group, for example, an alkylcarbamoyl group such as an ethylcarbamoyl group, an octylcarbamoyl group, a pentadecylcarbamoyl group, an octadecylcarbamoyl group, etc., an arylcarbamoyl group such as a phenylcarbamoyl group, a 2,4,6-trichlorophenylcarbamoyl group, etc., and a heterocyclic carbamoyl group such as a thiazolylcarbamoyl group, a benzothiazolylcarbamoyl group, an oxazolylcarbamoyl group, an imidazolylcarbamoyl group, a benzimidazolylcarbamoyl group, etc. $R_{36}$, $R_{37}$, $R_{38}$ and $R_{39}$ each represents one of the groups defined for $R_{35}$, and W represents non-metal atoms necessary to form a 5- or 6-membered ring described below condensed with the benzene ring. Preferred examples of the 5- or 6-membered ring include a benzene ring, a cyclohexene ring, a cyclopentene ring, a thiazole ring, an oxazole ring, an imidazole ring, a pyridine ring, a pyrrole ring, a tetrahydropyridine ring and so on.

Preferred examples of the high speed reactive type couplers represented by the general formulae (VI) to (IX) are illustrated below. However, the high speed reactive type couplers which can be employed in the present invention should not be construed as being limited to the following examples.

VI-1

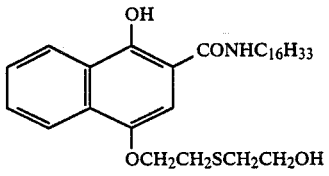

VI-2

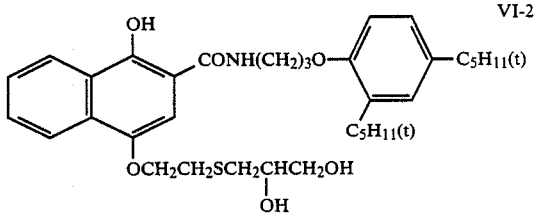

VI-3

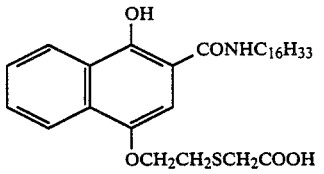

VI-4

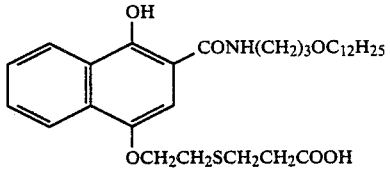

VI-5

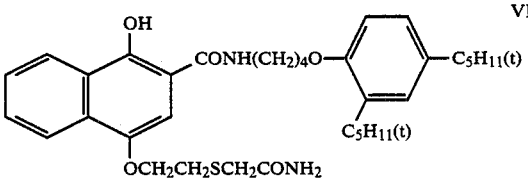

VI-6

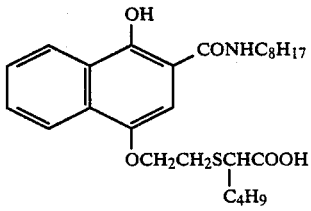

VI-7

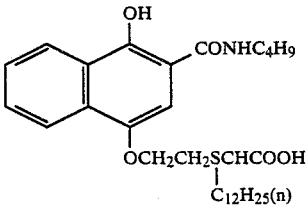

VI-8

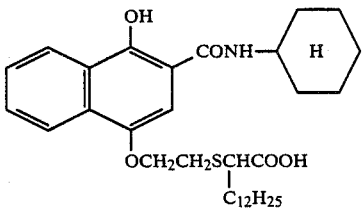

-continued
VI-9
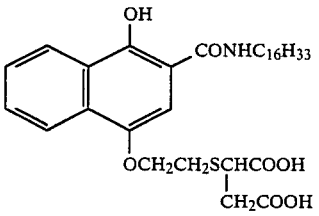
VI-10
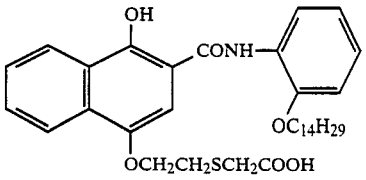
VI-11
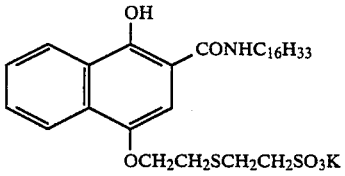
VI-12
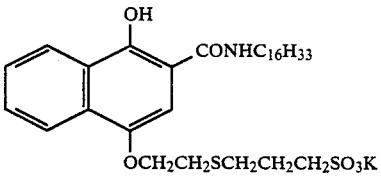
VI-13
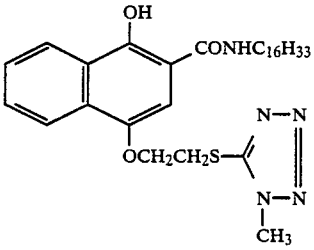
VI-14
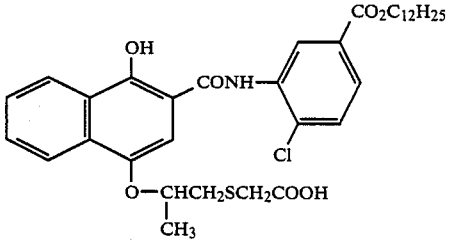
VI-15
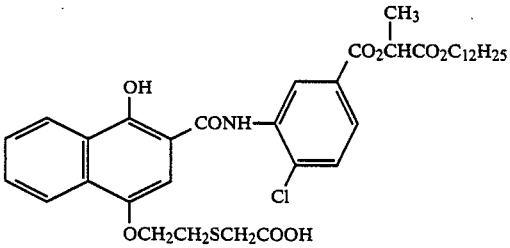
VI-16
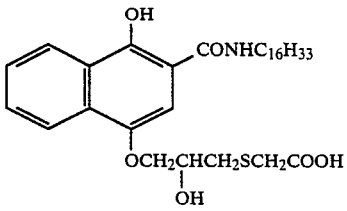
VI-17
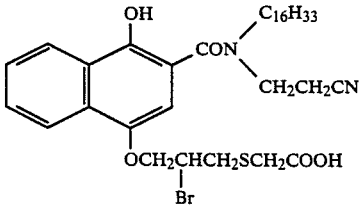
VI-18
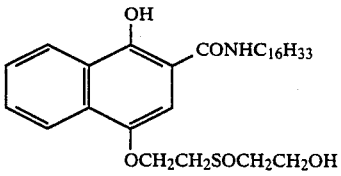
VI-19
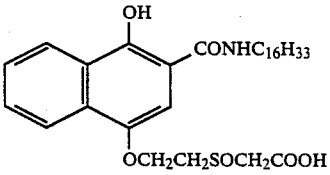
VI-20
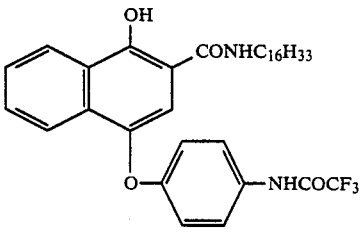
VI-21
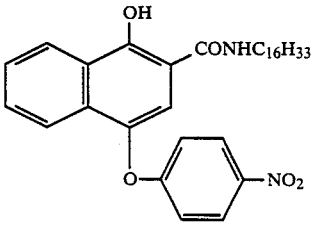
VI-22
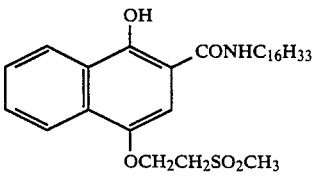

-continued
VI-23
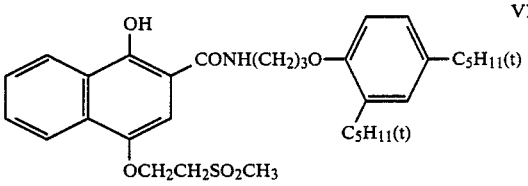
VI-24
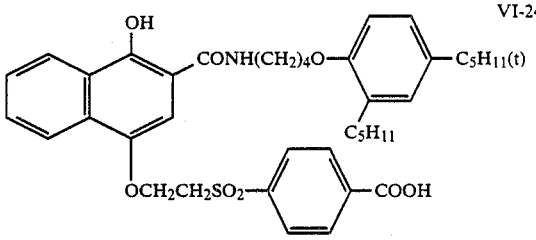
VI-25
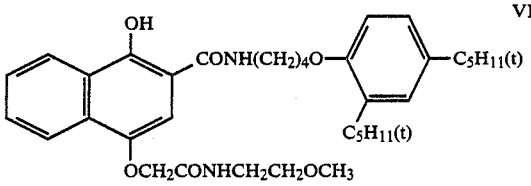
VI-26
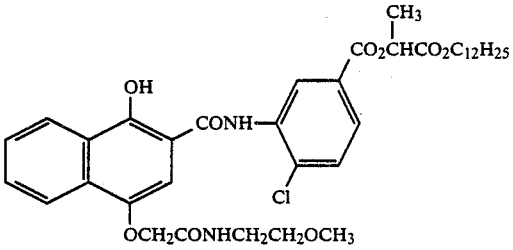
VI-27
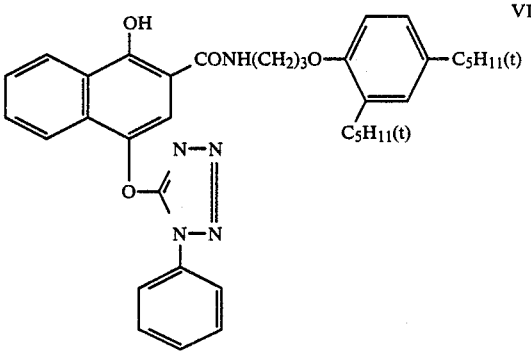
VI-28
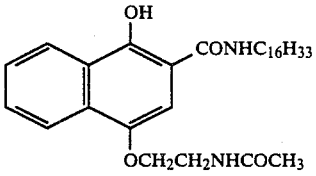
VI-29
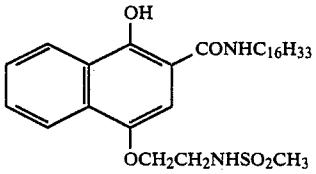
VI-30
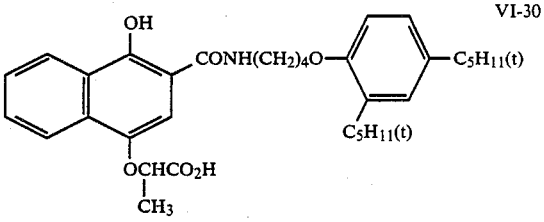
VI-31
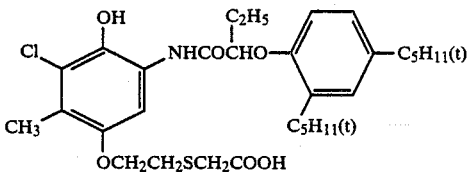
VI-32
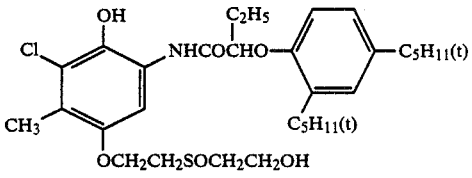
VI-33
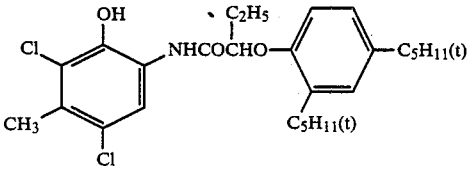
VI-34
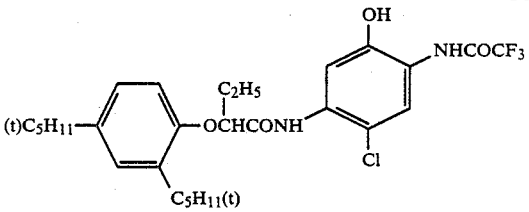

-continued

VI-35

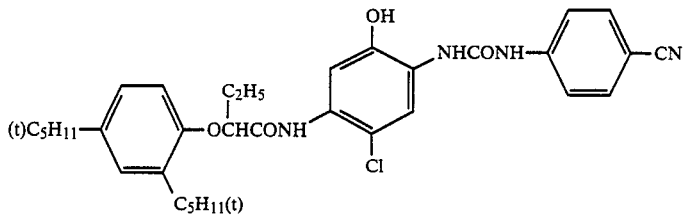

VI-36

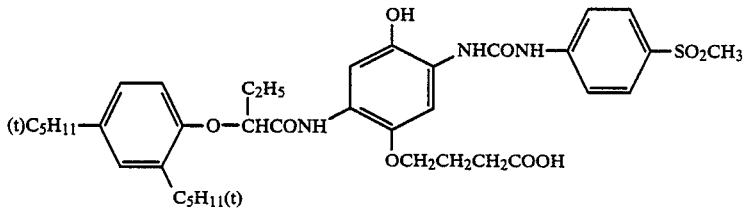

VI-37

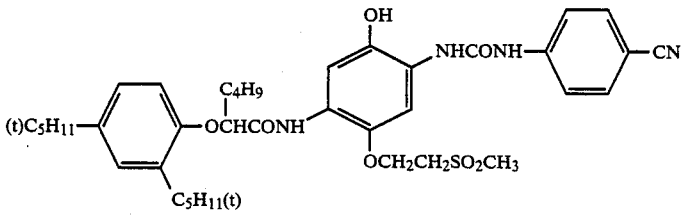

VI-38

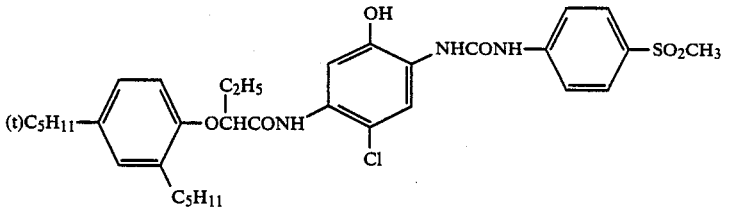

VI-39

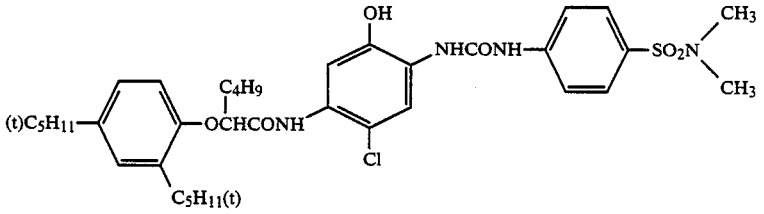

In general, the compound represented by the general formula (I) above can be synthesized as follows.

Namely, gallic acid is converted into 3,4,5-triacetoxybenzoic acid by reacting with acetic anhydride or acetic acid chloride in the presence of a base such as sodium hydroxide (*J. Chem. Soc.*, page 2495 (1931)), sodium carbonate, pyridine or so on and, further, converted into the corresponding acid chloride by reacting with thionyl chloride or phosphorus trichloride. The thus-obtained 3,4,5-triacetoxybenzoic acid chloride is reacted with an appropriate alcohol in the presence of a base such as pyridine, triethylamine or the like. Thereafter, the reaction product is treated with hydrochloric acid in methanol or ethanol to obtain a desired gallic acid ester. Also the desired gallic acid ester can be synthesized by directly reacting gallic acid with an alcohol in the presence of an acid catalyst such as sulfuric acid, p-toluenesulfonic acid, etc.

Preferred examples of syntheses of the compounds according to the present invention are described in detail below.

SYNTHESIS EXAMPLE 1

Synthesis of 3,4,5-Triacetoxybenzoic Acid

To 37.6 g (0.2M) of gallic acid dissolved in 50 ml of dimethylformamide was added 81.6 g (0.8M) of acetic anhydride in the presence of 63.3 g (0.8M) of pyridine while cooling with water. Then, the mixture was reacted at 60° C. for 2 hours. Thereto, 150 ml of water was added and, further, 80 ml of hydrochloric acid was added while cooling with ice. The white crystals thus-separated were collected by filtration under reduced pressure, washed with water and air-dried. Thus, 57.5 g of the desired compound was obtained. Yield: 97%, Melting Point: 163° to 166° C.

SYNTHESIS EXAMPLE 2

Synthesis of 3,4,5-Triacetoxybenzoic Acid Chloride

In 100 ml of 1,2-dichloroethane, 57 g (0.19M) of 3,4,5-triacetoxybenzoic acid and 34 g (0.29M) of thionyl chloride were reacted at 60° C. for 2 hours. The excess thionyl chloride and 1,2-dichloroethane were distilled off under reduced pressure. Thus, 61 g of the desired compound was obtained.

SYNTHESIS EXAMPLE 3

Synthesis of Compound I-12

31 g (0.1M) of 3,4,5-triacetoxybenzoic acid chloride and 32.6 g (0.1M) of 1-docosanol were dispersed in 150 ml of acetonitrile and to the dispersion was added 8.7 g (0.11M) of pyridine. The mixture was reacted at 60° C. for 4 hours, to which was added 300 ml of water. The crystals thus-separated were collected by filtration and recrystallized from 700 ml of ethanol. The compound thus-obtained were added to a solvent mixture of 100 ml of tetrahydrofuran and 100 ml of methanol, to which was added 10 ml of hydrochloric acid and the mixture was reacted at 35° C. for 5 hours. The reaction mixture was neutralized with 11 g of sodium hydrogen carbonate, to which was added 300 ml of water. The crystals thus-separated were collected by filtration and recrystallized from 450 ml of methanol to obtain 32.8 g of the desired compound. Yield: 69%, Melting Point: 86° to 91° C.

SYNTHESIS EXAMPLE 4

Synthesis of Compound I-3

To 18.8 g (0.1M) of gallic acid were added 29.6 g (0.4M) of 1-butanol and several drops of concentrated surfuric acid and the mixture was refluxed by heating for 8 hours. The excess 1-butanol was distilled off under reduced pressure and the residue was recrystallized from chloroform to obtain 12 g of the desired compound. Melting point: 142° C.

SYNTHESIS EXAMPLE 5

Synthesis of compound I-21

To 63 g of 3,4,5-triacetoxybenzoic acid chloride was added 50 ml of chloroform and to the mixture were added dropwise simultaneously 6.5 g of butanediol and 25.8 g of quinoline while cooling with stirring and the mixture was reacted at 60° C. for 5 hours. After adding water to the mixture, the crystal thus-separated were collected by filtration to obtain 45.8 g of triacetic acid ester of the desired compound. Yield: 98%, Melting Point: 141° to 143° C. The triacetic acid ester was hydrolized in the same manner as described for Compound I-12 to obtain 18 g of Compound I-21. Yield: 64%, Melting Point: 215° to 217° C.

Other compounds can be synthesized in the same manner as described above.

All of the couplers represented by the general formulae (II) to (VI) are known compounds. For instance, those which are represented by the general formulae (II) to (IV) are described in Japanese Patent Publication No. 10783/76, Japanese Patent Application (OPI) Nos. 66834/73, 66835/73, 102636/76, 122335/74, 34232/75, 9529/78, 39126/78, 47827/78 and 105226/78, Japanese Patent Publication No. 13576/74, Japanese Patent Application (OPI) Nos. 89729/76 and 75521/76, U.S. Pat. Nos. 4,059,447 and 3,894,875, and so on. The couplers represented by the general formula (V) are described in Japanese Patent Application (OPI) Nos. 122935/75, 126833/81, 38043/81, 46223/81, 58922/77, 20826/76, 122335/74 and 159336/75, Japanese Patent Publication Nos. 10100/76 and 37540/75, Japanese Patent Application (OPI) Nos. 112343/76, 47827/78 and 39126/78, Japanese Patent Publication No. 15471/70, U.S. Pat. No. 3,227,554, *Research Disclosure,* No. 161, RD-16140, and so on. The couplers represented by the general formula (VI) are described in Japanese Patent Application (OPI) Nos. 27147/81, 1938/81, 117422/75, 37425/72, 48237/79, 52423/78, 105226/78, 45524/78, 47827/78, 39745/78, 10135/75 and 120334/75, U.S. Pat. No. 3,476,563, and so on.

It is most advantageous to add the compound represented by the general formula (I) directly to a silver halide emulsion layer. However, it may be added to a light-insensitive layer, such as an interlayer, a protective layer, a yellow filter layer, an antihalation layer or so on. The compound according to the present invention can be firstly dissolved in an organic solvent having a high boiling point and, subsequently, dispersed into an aqueous medium and then added or it can be dissolved in an organic solvent having a low boiling point and then added.

Further, the compound represented by the general formula (I) of the present invention can be used in the form of mixture with a conventionally employed dihydroxybenzene derivative.

An amount of the compound represented by the general formula (I) to be employed is preferably in the range of 1 to 100 mole%, particularly 5 to 50 mole%, per mole of coupler.

Photographic emulsions to be employed in the present invention can be preared using various methods as described in, for example, P. Glafkides, *Chimie et Physique Photographique,* Paul Montel, Paris (1967), G. F. Duffin, *Photographic Emulsion Chemistry,* The Focal Press, London (1966), and V. L. Zelikman et al., *Making and Coating Photographic Emulsion,* The Focal Press, London (1964). Namely, the acid process, the neutral process, the ammonia process and so on may be employed. Suitable methods for reacting a water-soluble silver salt with a water-soluble halide include, e.g., a single jet method, a double jet method and a combination thereof.

Also, a method in which silver halide grains are produced in the presence of excess silver ion (the so-called reverse jet method) can be employed in the present invention. Further, the so-called controlled double jet method, in which the pAg of the liquid phase in which silver halide grains are to be precipitated is maintained constant, may be employed herein. According to this method, emulsions containing silver halide grains which have regular crystal forms and almost uniform grain sizes can be produced.

Two or more of silver halide emulsions prepared separately may be employed in a form of a mixture thereof.

In a process of producing silver halide grains or allowing the produced silver halide grains to ripen physically, cadmium salts, zinc salts, lead salts, thallium salts, iridium salts or complexes thereof, rhodium salts or complexes thereof, iron salts or complexes thereof, or the like may be present.

In general, after the production of silver halide grains or after the physical ripening thereof, soluble salts are removed from the silver halide emulsions. The removal can be effected using the noodle washing method which comprises gelling the gelatin, or using a sedimentation process (thereby causing flocculation in the emulsion) which takes advantage of a sedimenting agent such as inorganic salts, anionic surface active agents, anionic polymers (e.g., polystyrenesulfonic acid), or gelatin derivatives (e.g., acylated gelatins, carbamoylated gelatins, etc.).

The silver halide emulsions are generally subjected to chemical sensitization. The chemical sensitization can be carried out using processes as described in H. Frieser, *Die Grundlagen der Photographischen Prozesse mit Silberhalogeniden,* pages 675 to 734, Akademische Verlagsgesellschaft (1968), and so on.

As for a binder or a protective colloid to be employed in photographic emulsions, gelatin is used to greater advantage. However, hydrophilic colloids other than gelatin can also be employed.

Preferred examples of such hydrophilic colloids include proteins such as gelatin derivatives, gelatin grafted high polymers, albumin, casein, etc., polysuccharide derivatives such as cellulose derivatives, e.g., hydroxyethyl cellulose, carboxymethyl cellulose, cellulose sulfate, etc., sodium alginate, starch derivatives and the like; and various kinds of synthetic hydrophilic homo- or copolymers such as polyvinyl alcohol, polyvinyl alcohol partial acetal, poly-N-vinylpyrrolidone, polyacrylic acid, polymethacrylic acid, polyacrylamide, polyvinyl imidazole, polyvinyl pyrazole and so on.

Gelatin which may be employed in the present invention includes not only lime-processed gelatin but also acid-processed gelatin, and enzyme-processed gelatin as described in *Bull. Soc. Sci. Phot. Japan,* No. 16, p. 30 (1966). In addition, hydrolysis products of gelatin and enzymatic degradation products of gelatin can also be employed. Gelatin derivatives which can be employed in the present invention include those which are obtained by reacting gelatin with various kinds of compounds, for example, acid halides, acid anhydrides, isocyanates, bromoacetic acid, alkane sultones, vinyl sulfonamides, maleinimide compounds, polyalkylene oxides, epoxy compounds and so on. Preferred examples thereof are described in U.S. Pat. Nos. 2,614,928, 3,132,945, 3,186,846 and 3,312,553, British Pat. Nos. 861,414, 1,033,189 and 1,005,784, Japanese Patent Publication No. 26845/67, and so on.

The above-described gelatin grafted high polymers which can be employed include those which are obtained by grafting on gelatin homo- or copolymers of vinyl monomers such as acrylic acid, methacrylic acid, esters thereof, amido thereof, other derivatives thereof, acrylonitrile, styrene and so on. Among these polymers, those which are obtained by grafting, on gelatin, polymers being compatible with gelatin to some extents, e.g., polymers of acrylic acid, methacrylic acid, acrylamide, methacrylamide, hydroxyalkylmethacrylates and the like are more advantageously employed. Preferred examples of such grafted polymers are described in U.S. Pat. Nos. 2,763,625, 2,831,767 and 2,956,884, and so on.

Representative of synthetic hydrophilic macromolecular compounds which can be employed are described in German Patent Application (OLS) No. 2,312,708, U.S. Pat. Nos. 3,620,751 and 3,879,205, and Japanese Patent Publication No. 7561/68.

In the photographic emulsions according to the present invention, various kinds of compounds can be incorporated for the purposes of preventing fog from generating during preparation of the light-sensitive materials, upon storage of the light-sensitive materials or in the course of photographic processing, or stabilizing photographic properties of the light-sensitive materials. Preferred examples of compounds employed for such purposes include azoles such as benzothiazolium salts, nitroindazoles, triazoles, benzotriazoles, benzimidazoles (especially nitro or halogen substituted compounds), etc.; heterocyclic mercapto compounds such as mercaptothiazoles, mercaptobenzothiazoles, mercaptobenzimidazoles, mercaptothiadiazoles, mercaptotetrazoles (especially 1-phenyl-5-mercaptotetrazole), mercaptopyrimidines, etc.; the above-described heterocyclic mercapto compounds which have additionally water-soluble groups such as carboxyl group, sulfone group and the like; thioketone compounds such as oxazolinethione, etc.; azaindenes such as tetraazaindenes (especially 4-hydroxy-1,3,3a,7-tetraazaindenes), etc.; benzenethiosulfonic acids, benzenesulfinic acid; and other various compounds which have been known as antifogging agents or stabilizing agents.

Details of preferred examples and usages of these antifogging agents and stabilizing agents are described in U.S. Pat. Nos. 3,954,474, 3,982,947 and 4,021,248, and Japanese Patent Publication No. 28660/77.

The photographic emulsions according to the present invention may be spectrally sensitized using methine dyes or other dyes. Preferred spectral sensitizing dyes which can be employed include those which are described in German Pat. No. 929,080, U.S. Pat. Nos. 2,493,748, 2,503,776, 2,519,001, 2,912,329, 3,656,959, 3,672,897 and 4,025,349, British Pat. No. 1,242,588 and Japanese Patent Publication No. 14030/69.

These sensitizing dyes may be employed individually or in combination. Combinations of sensitizing dyes are often employed for the purpose of supersensitization. Preferred examples of supersensitizing combinations are described in U.S. Pat. Nos. 2,688,545, 2,977,229, 3,397,060, 3,522,052, 3,527,641, 3,617,293, 3,628,964, 3,666,480, 3,672,898, 3,679,428, 3,814,609 and 4,026,707, British Pat. No. 1,344,281, Japanese Patent Publication Nos. 4936/68 and 12375/78, and Japanese Patent Application (OPI) Nos. 110618/77 and 109925/77.

The photographic emulsion layers and other hydrophilic colloid layers of the photographic light-sensitive materials prepared in accordance with embodiments of the present invention may contain inorganic or organic hardeners. For example, chromium salts (such as chrome alum, chromium acetate, etc.), aldehydes (such as formaldehyde, glyoxal, glutaraldehyde, etc.), N-methylol compounds (such as dimethylolurea, methylol dimethylhydantoin, etc.), dioxane derivatives (such as 2,3-dihydroxydioxane, etc.), active vinyl compounds (such as 1,3,5-triacryloylhexahydro-s-triazine, 1,3-vinylsulfonyl-2-propanol, etc.), active halogen compounds (such as 2,4-dichloro-6-hydroxy-s-triazine, etc.), mucohalogenic acids (such as mucochloric acid, mucophenoxychloric acid, etc.) and so on can be employed individually or in a combination of two or more thereof.

In the photographic emulsions according to the present invention, color forming couplers, other than those having the general formulae (II) to (VI), that is to say, compounds capable of forming colors by the oxidative coupling with aromatic primary amine developing agents (e.g., phenylenediamine derivatives, aminophenol derivatives, etc.) In the color development processing, can be incorporated. Preferred examples of magenta couplers include 5-pyrazolone couplers, pyrazolobenzimidazole couplers, cyanoacetylcumaron couplers, open-chain acylacetonitrile couplers and so on. Preferred examples of yellow couplers include acylacetamide couplers (e.g., benzoyl acetanilides, pivaloyl acetanilides, etc.), and so on. Preferred examples of cyan couplers include naphthol couplers, phenol couplers and so on. In addition, polymer couplers described in U.S. Pat. Nos. 4,080,211, 3,451,820 and 3,370,952, and so on can be employed. The above-described couplers may be employed individually or in combination. Of these couplers, non-diffusion type couplers which have hydrophobic groups called ballast groups in their individual molecules are employed to greater advantage. These couplers may be either 4-equivalent or 2-equivalent with respect to silver ions. Further, colored couplers having color correction effects, or couplers capable of releasing development inhibitors with the progress of development (the so-called DIR couplers) may be contained.

Besides DIR couplers, non-color-forming DIR coupling compounds which yield colorless products upon the coupling reaction and that can release development inhibitors may be incorporated in the photographic emulsions according to the present invention.

These couplers are introduced into silver halide emulsion layers using known methods as described in, for example, U.S. Pat. No. 2,322,027. For instance, these couplers are dissolved in organic solvents having a high boiling point, with preferred examples including alkyl phthalates (such as dibutyl phthalate, dioctyl phthalate, etc.), phosphates (such as diphenyl phosphate, triphenyl phosphate, tricresyl phosphate, dioctylbutyl phosphate, etc.), citrates (such as tributyl acetylcitrate, etc.), benzoates (such as octylbenzoate, etc.), alkylamides (such as diethyl lauryl amide, etc.), fatty acid esters (such as dibutoxyethyl succinate, dioctyl azelate, etc.), trimesic acid esters (such as tributyl trimesate, etc.) and so on; or in organic solvents having a boiling point of about 30° C. to about 150° C., with preferred examples including lower alkyl acetates such as ethyl acetate, butyl acetate, etc., ethyl propionate, sec-butyl alcohol, methyl isobutyl ketone, β-ethoxyethyl acetate, methyl cellosolve acetate and so on; and then dispersed into hydrophilic colloids. Mixtures of the above-described organic solvents having a high boiling point and the above-described organic solvent having a low boiling point may be employed for dissolving such couplers.

In addition, such couplers may be dispersed using the dispersing method which comprises utilizing polymers, as described in Japanese Patent Publication No. 39853/76 and Japanese Patent Application (OPI) No. 59943/76.

On the occasion that couplers contain acid groups such as carboxylic acid, sulfonic acid and the like, these are introduced into hydrophilic colloids in the form of an alkaline aqueous solution.

Photographic processing of the light-sensitive materials prepared in accordance with embodiments of the present invention can be carried out using known methods. Processing solutions which can be employed include those which have so far been known. Processing temperatures are generally selected from the range of 18° C. to 50° C. However, temperatures lower than 18° C. or temperatures higher than 50° C. may be employed. Either the development processing for forming silver image (black-and-white photographic processing) or the color photographic processing which comprises a development processing for forming dye image can be applied to the light-sensitive materials of the present invention according to their end-use purposes.

Developing solutions to be employed in the case of black-and-white photographic processing can contain known developing agents. Preferred examples of developing agents which can be employed include dihydroxybenzenes (such as hydroquinone), 3-pyrazolidiones (such as 1-phenyl-3-pyrazolidone), aminophenols (such as N-methyl-p-aminophenol), 1-phenyl-3-pyrazolines, ascorbic acid, and heterocyclic compounds such as that formed by condensation of 1,2,3,4-tetrahydroquinoline ring and indolene ring as described in U.S. Pat. No. 4,067,872. These developing agents may be employed individually or in combination. In addition to such a developing agent, the developing solution may generally contain a known preservative, alkali agent, pH buffer and antifoggant and, further, it may optionally contain a dissolving aid, a color toning agent, a development accelerator, a surface active agent, a defoaming agent, a water softener, a hardener, a viscosity imparting agent and so on.

The development processing may be carried out in such a special manner that a developing agent is incorporated in a light-sensitive material, for example, in its emulsion layer and the light-sensitive material is processed in an alkaline aqueous solution. Hydrophobic compounds in the above-described developing agents can be incorporated in emulsion layers in a form of a latex dispersion, as disclosed in *Research Disclosure,* No. 169, RD-16928. Such development processing as described above may be carried out in combination with the silver salt stabilizing processing using a thiocyanate.

Fixing solutions which can be employed include those which have conventional compositions.

Preferred examples of fixing agents which can be employed include thiosulfates, thiocyanates and organic sulfur compounds which have so far been known to have fixing effects.

The fixing solution may contain a water-soluble aluminum salt as a hardener.

Dye images can be formed in conventional manners. For instance, the nega-posi process (described in, for example, *Journal of the Society of Motion Picture and Television Engineers,* Vol. 61, pp. 667–701 (1953)); the color reversal process which comprises forming negative silver image through development using a developing solution containing a black-and-white developing agent, carrying out at least one uniform exposure or another appropriate fogging treatment, and carrying out color development to produce a positive dye image; silver dye bleach process which comprises forming silver image by developing an exposed dye-containing photographic emulsion layers, and bleaching dyes utilizing the silver image as catalyst; and so on can be employed.

A color developing solution generally comprises an alkaline aqueous solution containing a color developing agent. Preferred examples of the color developing agent which can be employed include known aromatic primary amine developing agents such as phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, 4-amino-3-methyl-N-ethyl-N-β-methoxyethylaniline, etc.).

In addition to the above-described color developing agents, those which are described in L. F. A. Mason, *Photographic Processing Chemistry*, pp. 226–229, Focal Press, London (1966), U.S. Pat. Nos. 2,193,015 and 2,592,364, Japanese Patent Application (OPI) No. 64933/73, and so on may be employed.

The color developing solution can additionally contain pH buffers such as sulfites, carbonates, borates and phosphates of alkali metals; development restrainers or antifoggants such as bromides, iodides and organic antifoggants; and so on. Further, it may optionally contain water softeners; preservatives such as hydroxyamine; organic solvents such as benzyl alcohol, diethylene glycol and the like; development accelerators such as polyethylene glycol, quaternary ammonium slts, amines and the like; dye forming couplers; competing couplers; fogging agents such as sodium borohydride; auxiliary developing agents such as 1-phenyl-3-pyrazolidone; viscosity imparting agents; polycarboxylic acid series chelating agents as described in U.S. Pat. No. 4,083,723; antioxidants as described in German Patent Application (OLS) No. 2,622,950; and so on.

After the color development, photographic emulsion layers are generally subjected to a bleach processing. The bleach processing may be carried out simultaneously with a fixation processing or individually. Bleaching agents which can be employed include compounds of polyvalent metals such as Fe (III), Co (III), Cr (VI), Cu (II) and the like; peroxy acids; quinones; nitroso compounds; and so on. Preferred examples thereof include ferricyanides; dichromates; organic complex salts of Fe (III) or Co (III), for example, the complex salts of organic acids such as aminopolycaraboxylic acids (e.g., ethylenediaminetetraacetic acid, nitrilotriacetic acid, 1,3-diamino-2-propanoltetraacetic acid, etc.), citric acid, tartaric acid, malic acid and so on; persulfates and permanganates; nitrosophenol; and so on. Among these bleaching agents, potassium ferricyanide, sodium ethylenediaminetetraacetatoferrate (III) and ammonium ethylenediaminetetraacetatoferrate (III) are especially useful. In particular, ethylenediaminetetraacetatoiron (III) complexes are used to advantage in other independent bleaching solutions and combined mono-bath bleach-fixing solutions.

To a bleaching solution of a bleach-fixing solution can be added bleach accelerators as described in, e.g., U.S. Pat. Nos. 3,0425,520 and 3,241,966, Japanese Patent Publication Nos. 8506/70 and 8836/70, and so on; thiol compounds as described in Japanese Patent Application (OPI) No. 65732/78; and other various kinds of additives.

The light-sensitive materials prepared in accordance with embodiments of the present invention may be development-processed using developing solutions which are replenished or controlled so as to maintain their developabilities constant using the methods as described in Japanese Patent Application (OPI) Nos. 84636/76, 119934/77, 46732/78, 9626/79, 19741/79, 37731/79, 1048/81, 1049/81 and 27142/81.

The light-sensitive materials prepared in accordance with embodiments of the present invention may be processed with bleach-fixing solutions which are subjected to recovering treatments according to the methods as described in Japanese Patent Application (OPI) Nos. 781/71, 49437/73, 18191/73, 145231/75, 18541/76, 19535/76 and 144620/76, and Japanese Patent Publication No. 23178/76.

The present invention is explained in greater detail with reference to the examples below, but the present invention should not be construed as being limited thereto.

EXAMPLE 1

On a cellulose triacetate film support were coated the layers having the compositions set forth below to prepare a multilayer color photographic light-sensitive material.

First Layer: Antihalation Layer (AHL)

A gelatin layer containing black colloidal silver.

Second Layer: Intermediate Layer (ML)

A gelatin layer containing a dispersion of 2,5-di-tertoctylhydroquinone

Third Layer: First Red-Sensitive Emulsion Layer ($RL_1$)

A silver iodobromide emulsion (iodide content: 5 mol%) silver coated amount: 1.79 g/m$^2$ Sensitizing Dye I: $6\times10^{-5}$ mol per mol of silver Sensitizing Dye II: $1.5\times10^{-5}$ mol per mol of silver Coupler A: 0.04 mol per mol of silver Coupler C: 0.003 mol per mol of silver Coupler D: 0.0006 mol per mol of silver Fourth Layer: Second Red-Sensitive Emulsion Layer ($RL_2$)

A silver iodobromide emulsion (iodide content: 4 mol%) silver coated amount: 1.4 g/m$^2$ Sensitizing Dye I: $3\times10^{-5}$ mol per mol of silver Sensitizing Dye II: $1.2\times10^{-5}$ mol per mol of silver Coupler VI-3: 0.02 mol per mol of silver Compound (I-10): 0.005 mol per mol of silver Coupler C: 0.0016 mol per mol of silver Compound (I-10) was dispersed together with the couplers used.

Fifth Layer: Intermediate Layer (ML)

Same as the Second Layer

Sixth Layer: First Green-Sensitive Emulsion Layer ($GL_1$)

A silver iodobromide emulsion (iodide content: 4 mol%) silver coated amount: 1.5 g/m$^2$ Sensitizing Dye III: $3\times10^{-5}$ mol per mol of silver Sensitizing Dye IV: $1\times10^{-5}$ mol per mol of silver Coupler B: 0.05 mol per mol of silver Coupler M: 0.008 mol per mol of silver Coupler D: 0.0015 mol per mol of silver Seventh Layer: Second Green-Sensitive Emulsion Layer ($GL_2$)

A silver iodobromide emulsion (iodide content: 5 mol%) silver coated amount: 1.6 g/m$^2$ Sensitizing Dye III: $2.5\times10^{-5}$ mol per mol of silver Sensitizing Dye IV: $0.8\times10^{-5}$ mol per mol of silver Coupler B: 0.02 mol per mol of silver Coupler M: 0.003 mol per mol of silver Coupler D: 0.0003 mol per mol of silver Eighth Layer: Yellow Filter Layer (YEL)

A gelatin layer containing yellow colloidal silver and a dispersion of 2,5-di-tert-octylhydroquinone Ninth Layer: First Blue-sensitive Emulsion Layer ($BL_1$)

A silver iodobromide emulsion (iodide content: 6 mol%) silver coated amount: 1.5 g/m$^2$ Coupler II-24: 0.25 mol per mol of silver Tenth Layer: Second Blue-Sensitive Emulsion Layer ($BL_2$)

A silver iodobromide emulsion (iodide content: 6 mol%) silver coated amount: 1.1 g/m$^2$ Coupler II-24: 0.06 mol per mol of silver.

Eleventh Layer: Protective Layer (PL)

A gelatin layer containing polymethyl methacrylate particles (having a diameter of about 1.5 microns).

A gelatin hardener and a surface active agent were incorporated into each of the layers in addition to the above described components.

The thus-prepared sample was designated Sample 101.

The compounds used for the preparation of the above-described sample were:

Sensitizing Dye I:

Pyridinium salt of anhydro-5,5'-dichloro-3,3'-(γ-sulfopropyl)-9-ethylthiacarbocyanine hydroxide Sensitizing Dye II:

Triethylamine salt of anhydro-9-ethyl-3,3'-di-(γ-sulfopropyl)-4,5,4',5'-dibenzothiacarbocyanine hydroxide Sensitizing Dye III:

Sodium salt of anhydro-9-ethyl-5,5'-dichloro-3,3'-di-(γ-sulfopropyl)oxacarbocyanine Sensitizing Dye IV:

Sodium salt of anhydro-5,6,5',6'-tetrachloro-1,1'-diethyl-3,3'-di-{β-[β-(γ-sulfopropoxy)ethoxy]ethyl-}imidazolocarbocyanine hydroxide Coupler A

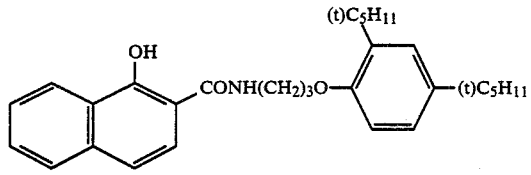

Coupler B

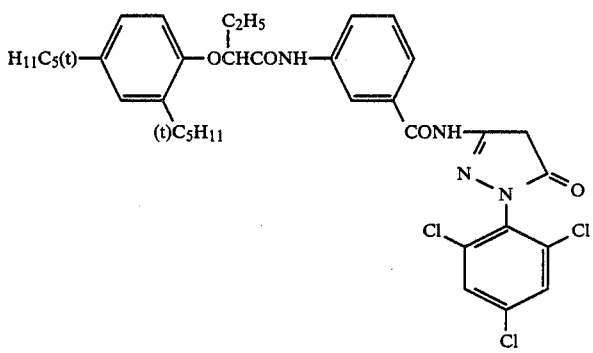

Coupler C

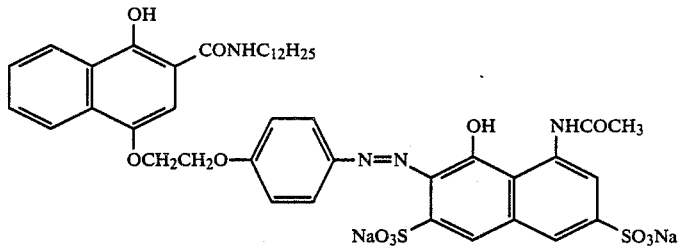

Coupler D

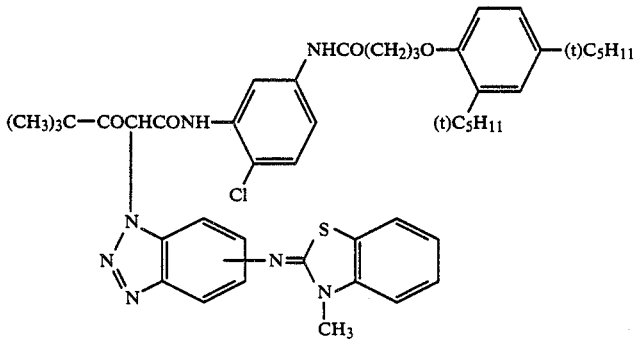

-continued

Coupler M

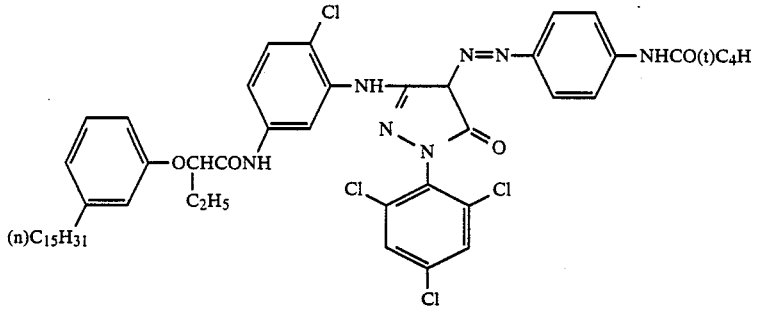

Note: Coupler VI-3 incorporated in $RL_2$ had a relative coupling speed of 0.75.

SAMPLES 102 TO 105 (This Invention)

Samples 102 to 105 were prepared in the same manner as described in the preparation of Sample 101 except that Compound (I-12), Compound (I-3), Compound (I-18) and Compound (I-21), respectively, were employed in the amount as shown in Table 1 below in place of Compound (I-10) incorporated in $RL_2$ of Sample 101.

SAMPLE 106 (for comparison)

Sample 106 was prepared in the same manner as described in the preparation of Sample 101 except that Coupler A was employed in place of Coupler VI-3 and Compound (I-10) incorporated in $RL_2$ of Sample 101 and that the amount of Coupler A was twice that of Coupler VI-3.

Coupler A had a relative coupling speed of 0.15.

SAMPLE 107 (for comparison)

Sample 107 was prepared in the same manner as described in the preparation of Sample 101 except that the addition of Compound (I-10) to $RL_2$ of Sample 101 was omitted, and a grain size of the emulsion was changed so as to have equivalent sensitivity to that of Sample 101.

SAMPLE 108 (for comparison)

Sample 108 was prepared in the same manner as described in the preparation of Sample 101 except that a DIR Coupler (Coupler D) was employed in place of Compound (I-10) incorporated in $RL_2$ of Sample 101 and that an addition amount thereof was 10 mol% to that of Coupler VI-3. The DIR coupler was chosen for comparison because it was known that the DIR coupler (Coupler D) could improve granularity.

SAMPLE 109 (for comparison)

Sample 109 was prepared in the same manner as described in the preparation of Sample 101 except that Coupler A was employed in place of Coupler VI-3; namely, Sample 109 was the same as Sample 106 except that Compound (I-10) was incorporated in $RL_2$ of Sample 101.

Each of the thus-obtained Samples 101 to 109 was exposed to white light through a wedge. These samples were almost equal in sensitivity and gradation. However, Sample 109 failed to render the sensitivity and gradation equal to those of Samples 101 to 108; rather, the sensitivity was extremely low and the gradation became extremely soft in Sample 109.

The granularity of the cyan dye image formed in these samples was determined using the conventional root mean square (RMS) method. Determination of the granularity using the RMS method is described in *Photographic Science and Engineering,* Vol. 19, No. 4, pp. 235–238 (1975) with a title "RMS Granularity; Determination of Just Noticeable Difference".

RMS values at densities of 0.3 and 1.0, respectively, are set forth in Table 1. Samples 101 to 105 in accordance with the present invention in which the compound belonging to general formula (I) was used in combination with the high speed reactive type coupler had excellent granularities, irrespective of image density. However, the granularities of Samples 106 to 108 were poor. Even through DIR coupler (Coupler D) was used with an attempt to improve granularity in accordance with the prior art teaching, merely poor granularity was obtained. In Sample 109 in which a low speed reactive type coupler was used, RMS values were out of question because neither sensitivity nor gradation could be rendered on equal level due to serious lowering in sensitivity and extremely soft gradation.

Development processing employed herein was as follows:

| Development Processing | Temperature (°C.) | Time |
|---|---|---|
| 1. Color Development | 38 | 3 min 15 sec |
| 2. Bleaching | " | 6 min 30 sec |
| 3. Water Washing | " | 3 min 15 sec |
| 4. Fixing | " | 6 min 30 sec |
| 5. Water Washing | " | 3 min 15 sec |
| 6. Stabilizing | " | 3 min 15 sec |

The processing solutions used in the above-described steps had the following compositions.

| | |
|---|---|
| Color Developing Solution | |
| Sodium Nitrilotriacetate | 1.0 g |
| Sodium Sulfite | 4.0 g |
| Sodium Carbonate | 30.0 g |
| Potassium Bromide | 1.4 g |
| Hydroxylamine Sulfate | 2.4 g |
| 4-(N—Ethyl-N—β-hydroxyethylamino)-2-methylaniline Sulfate | 4.5 g |
| Water to make | 1 liter |
| Bleaching Solution | |
| Ammonium Bromide | 160.0 g |
| Ammonia Water (28%) | 25.0 ml |
| Sodium Ethylenediaminetetraacetato-ferrate (III) | 130.0 g |
| Glacial Acetic Acid | 14.0 ml |
| Water to make | 1 liter |
| Fixing Solution | |
| Sodium Tetrapolyphosphate | 2.0 g |
| Sodium Sulfite | 4.0 g |
| Ammonium Thiosulfate (70%) | 175.0 ml |
| Sodium Hydrogensulfite | 4.6 g |
| Water to make | 1 liter |

-continued

| Stabilizing Solution | |
|---|---|
| Formaldehyde | 8.0 ml |
| Water to make | liter |

TABLE 1

| Sample | Coupler | Relative Coupling Speed | Compound | Amount of Compound Added | RMS value D = 0.3 + fog | RMS value D = 1.0 + fog |
|---|---|---|---|---|---|---|
| 101 | VI-3 | 0.75 | (I-10) | 0.005 | 0.0173 | 0.0125 |
| 102 | VI-3 | | (I-12) | 0.006 | 0.0174 | 0.0125 |
| 103 | VI-3 | | (I-3) | 0.003 | 0.0172 | 0.0126 |
| 104 | VI-3 | | (I-18) | 0.005 | 0.0173 | 0.0124 |
| 105 | VI-3 | | (I-21) | 0.002 | 0.0170 | 0.0126 |
| 106 | A | 0.15 | — | — | 0.0172 | 0.0150 |
| 107 | VI-3 | | — | — | 0.0185 | 0.0126 |
| 108 | VI-3 | | (D) | 0.002 | 0.0175 | 0.0142 |
| 109 | A | | (I-10) | 0.005 | — | — |

EXAMPLE 2

Preparation of Sample 201

On a cellulose triacetate film support were coated the layers having the compositions described below to prepare a multilayer color photographic light-sensitive material.

First Layer: Red-Sensitive Emulsion Layer

A silver iodobromide emulsion (iodide content: 5 mol%) silver coated amount: 2.5 g/m$^2$ Sensitizing Dye I: $6\times10^{-5}$ mol per mol of silver Sensitizing Dye II: $1.5\times10^{-5}$ mol per mol of silver Coupler VI-3: 0.02 mol per mol of silver Compound (I-10): 20 mol% to the content of Coupler VI-3

Second Layer: Protective Layer

A gelatin layer containing polymethyl methacrylate particles (having a diameter of about 1.5 microns)

A gelatin hardener and a surface active agent were incorporated into each of the layers in addition to the above described components.

SAMPLES 202 TO 206

Samples 202 to 206 were prepared in the same manner as described in the preparation of Sample 201 except that Coupler VI-3 and Compound (I-10) incorporated in the first layer were changed to those set forth in Table 2 below, respectively.

SAMPLES 207 TO 209

Samples 207 to 209 were prepared in the same manner as described in the preparation of Sample 201 except that the addition of Compound (I-10) was omitted from the first layer, that the couplers were changed as set forth in Table 2 below, and that grain size of the emulsions were changed so as to have the sensitivities equivalent to that of Sample 201, respectively.

Each of the thus-prepared Samples 201 to 209 was subjected to the photographic processing and evaluated in the same manner as employed in Example 1 except that the time for color development was reduced to 2 minutes. The results thus obtained are shown in Table 2 below.

The samples in which the compounds belonging to formula (I) were used in combiantion with the high speed reactive type couplers were superior in granularity to the samples free from the compounds of the present invention.

TABLE 2

| Sample | Coupler | Relative Coupling Speed | Compound | Amount of Compound Added (mol % to coupler) | RMS Values (D = 0.3 + fog) |
|---|---|---|---|---|---|
| 201 | VI-3 | 0.75 | (I-10) | 30 | 0.019 |
| 202 | VI-8 | 0.74 | " | 20 | 0.016 |
| 203 | VI-22 | 0.38 | " | 5 | 0.015 |
| 204 | VI-3 | 0.75 | (I-18) | 30 | 0.018 |
| 205 | VI-8 | 0.74 | " | 20 | 0.016 |
| 206 | VI-22 | 0.38 | " | 5 | 0.014 |
| 207 | VI-3 | 0.75 | — | — | 0.025 |
| 208 | VI-8 | 0.74 | — | — | 0.018 |
| 209 | VI-22 | 0.38 | — | — | 0.019 |

EXAMPLE 3

Preparation of Sample 301

On a cellulose triacetate film support were coated the layers having compositions described below to prepare a multilayer color photographic light-sensitive material.

First Layer: Green-Sensitive Emulsion Layer

A silver iodobromide emulsion (iodide content: 5 mol%) silver coated amount: 2.5 g/m$^2$ Sensitizing Dye III: $2.5\times10^{-5}$ mol per mol of silver Sensitizing Dye IV: $0.8\times10^{-5}$ mol per mol of silver Coupler V-20: 0.02 mol per mol of silver Compound (I-10): 10 mol% to the content of Coupler V-20

Second Layer: Protective Layer

A gelatin layer containing polymethyl methacrylate particles (having a diameter of about 1.5 microns)

A gelatin hardener and a surface active agent were incorporated into each of the layers in addition to the above described components.

SAMPLES 302 TO 306

Samples 302 to 306 were prepared in the same manner as described in the preparation of Sample 301 except that Coupler V-20 and Compound (I-10) incorporated in the first layer were changed to those set forth in Table 3 below, respectively.

SAMPLES 307 TO 309

Samples 307 to 309 were prepared in the same manner as described in the preparation of Sample 301 except that the addition of Compound (I-10) was omitted from the first layer, that the couplers were changed as set forth in Table 3 below and that grain sizes of the emulsions were changed so as to have the sensitivities equivalent to that of Sample 301, respectively.

Each of the thus-prepared Samples 301 to 309 was evaluated using the same procedure as employed in Example 2. The results thus obtained are shown in Table 2 below.

The samples containing the compounds of the present invention, irrespective of coupler to be employed in combination therewith, were superior in granularity to the samples in which any of the compounds of the present invention were not incorporated.

TABLE 3

| Sample | Coupler | Relative Coupling Speed | Compound | Amount of Compound Added (mol % to coupler) | RMS Values (D = 0.3 + fog) |
|---|---|---|---|---|---|
| 301 | V-20 | 0.82 | (I-10) | 20 | 0.016 |
| 302 | V-7 | 0.72 | " | 15 | 0.016 |
| 303 | V-45 | 0 45 | " | 10 | 0.014 |
| 304 | V-20 | 0.82 | (I-18) | 20 | 0.015 |
| 305 | V-7 | 0.72 | " | 15 | 0.014 |
| 306 | V-45 | 0.45 | " | 10 | 0.014 |
| 307 | V-20 | 0.82 | — | — | 0.020 |
| 308 | V-7 | 0.72 | — | — | 0.019 |
| 309 | V-45 | 0.45 | — | — | 0.016 |

While the invention has been described in detail and with reference to specific embodiments thereof, it will be apparent to one skilled in the art that various changes and modifications can be made therein without departing from the spirit scope thereof.

What is claimed is:

1. A silver halide color photographic light-sensitive material comprising a support having thereon a red-sensitive silver halide emulsion layer containing a cyan color forming coupler, a green-sensitive silver halide emulsion layer containing a magenta color forming coupler and a blue-sensitive silver halide emulsion layer containing a yellow color forming coupler, at least one of the red-sensitive silver halide emulsion layer or blue-sensitive silver halide containing a high speed reactive type coupler possessing a relative coupling speed of 0.6 to 1.0 represented by the following formulae (II), (III) or (IV), as the yellow color forming coupler for the blue sensitive layer or represented by the formula (VI) as the cyan color forming coupler for the red sensitive layer:

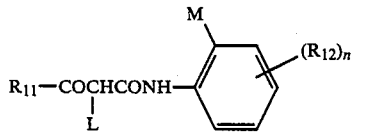

(II)

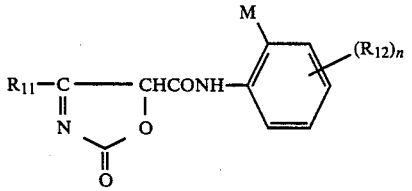

(III)

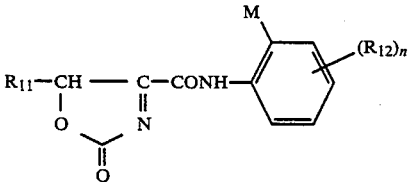

(IV)

$(A)_m$—Z (VI)

wherein $R_{11}$ represents an alkyl group or an aryl group, each of which may be substituted; $R_{12}$ represents a substituent which can be substituted for a hydrogen atom attached to the benzene ring; n represents an integer of 1 or 2, and when n is 2, two substituents represented by $R_{12}$ may be the same or different; M represents a halogen atom, an alkoxy group or an aryloxy group; L represents a group capable of being released from the coupler upon the formation of a dye through oxidative coupling with an aromatic primary amine developing agent; A represents an image forming coupler residue which has a naphthol nucleus or a phenol nucleus; m represents 1 or 2; and Z represents a group which is attached to the coupling position of the above-described coupler residue A and is capable of being released from coupler (VI) upon the formation of a dye through oxidative coupling with an aromatic primary developing agent; and a compound represented by the following general formula (I):

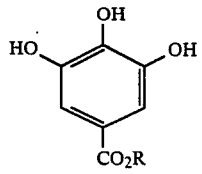

(I)

wherein R represents a hydrogen atom, a substituted or unsubstituted aliphatic group, a substituted or unsubstituted aromatic group, or a substituted or unsubstituted heterocyclic group.

2. A silver halide color photographic light-sensitive material as claimed in claim 1, wherein the aliphatic group represented by R is a straight chain or branched chain alkyl group, a straight chain or branched chain alkenyl group, a cycloalkyl group or a straight chain or branched chain alkynyl group.

3. A silver halide color photographic light-sensitive material as claimed in claim 1, wherein the aliphatic group represented by R is a straight chain or branched chain alkyl group having from 1 to 30 carbon atoms, a straight chain or branched chain alkenyl group having from 2 to 30 carbon atoms, a cycloalkyl group having from 3 to 12 carbon atoms or a straight chain or branched chain alkynyl group having from 3 to 30 carbon atoms.

4. A silver halide color photographic light-sensitive material as claimed in claim 1, wherein the aromatic group represented by R is a phenyl group or a naphthyl group.

5. A silver halide color photographic light-sensitive material as claimed in claim 1, wherein the heterocyclic group represented by R is a thiazolyl group, an oxazolyl group, an imidazolyl group, a furyl group, a thienyl group, a tetrahydrofuryl group, a piperidyl group, a thiadiazolyl group, a oxadiazolyl group, a benzothiazolyl group, a benzoxazolyl group or a benzimidazolyl group.

6. A silver halide color photographic light-sensitive material as claimed in claim 1, wherein a substituent for the substituted aliphatic group, the substituted aromatic group or the substituted heterocyclic group represented by R is an alkoxy group, an aryloxy group, a hydroxy group, an alkoxycarbonyl group, an aryloxycarbonyl group, a halogen atom, a carboxy group, a sulfo group, a cyano group, an alkyl group, an alkenyl group, an aryl group, an alkylamino group, an arylamino group, a carbamoyl group, an alkylcarbamoyl group, an arylcarbamoyl group, an acyl group, a sulfonyl group, an acyloxy group or an acylamino group.

7. A silver halide color photographic light-sensitive material as claimed in claim 1, said silver halide color photographic light-sensitive material exhibiting improved graininess in both high density areas and low density areas after imagewise exposure and development.

8. A silver halide color photographic light-sensitive material as claimed in claim 1, wherein the high speed reactive type coupler is represented by the general formula (II).

9. A silver halide color photographic light-sensitive material as claimed in claim 1, wherein the alkyl group represented by $R_{11}$ is an alkyl group having from 1 to 8 carbon atoms.

10. A silver halide color photographic light-sensitive material as claimed in claim 1, wherein the alkyl group represented by $R_{11}$ is a branched chain alkyl group.

11. A silver halide color photographic light-sensitive material as claimed in claim 1, wherein $R_{11}$ is a tert-butyl group.

12. A silver halide color photographic light-sensitive material as claimed in claim 1, wherein $R_{12}$ is a halogen atom,

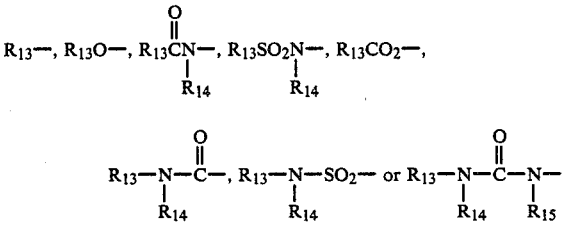

wherein $R_{13}$, $R_{14}$ and $R_{15}$ each represents a hydrogen atom, an alkyl group which may be substituted, an aryl group which may be substituted or a heterocyclic group which may be substituted.

13. A silver halide color photographic light-sensitive material as claimed in claim 12, wherein $R_{13}$ and $R_{14}$ each represents an alkyl group which may be substituted or an aryl group which may be substituted.

14. A silver halide color photographic light-sensitive material as claimed in claim 1, wherein M represents a fluorine atom or a chlorine atom.

15. A silver halide color photographic light-sensitive material as claimed in claim 1, wherein M represents a methoxy group.

16. A silver halide color photographic light-sensitive material as claimed in claim 1, wherein L represents a halogen atom, $-SR_{16}$ group (wherein $R_{16}$ represents an alkyl group, an aryl group, a heterocyclic group or an acyl group), $-OR_{17}$ group (wherein $R_{17}$ represents an alkyl group, an aryl group, a heterocyclic group or an acyl group) or

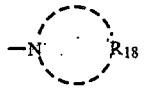

group (wherein $R_{18}$ represents a non-metallic atomic group necessary to form a 5- or 6-membered ring together with $-N<$.

17. A silver halide color photographic light-sensitive material as claimed in claim 1, wherein Z represents a halogen atom, —SCN, —NCS, $-NHSO_2R_{31}$, $-NHCOR_{31}$,

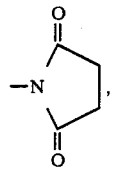

$-OR_{31}$, $-OSO_2R_{31}$, $-OCONR_{31}R_{32}$, $-OCOR_{31}$, $-OCSR_{31}$, $-OCOCO-R_{31}$, $-OCSNR_{31}R_{32}$, $-OCOOR_{31}$, $-OCOSR_{31}$ or $-SR_{31}$ wherein $R_{31}$ and $R_{32}$ each represents an aliphatic group which may be substituted, an aromatic group which may be substituted or a heterocyclic group which may be substituted; $R_{32}$ further represents a hydrogen atom.

18. A silver halide color photographic light-sensitive material as claimed in claim 17, wherein the aliphatic group represented by $R_{31}$ or $R_{32}$ is a straight chain or branched chain alkyl group, an alkenyl group, an alkynyl group or an alicyclic hydrocarbon group.

19. A silver halide color photographic light-sensitive material as claimed in claim 17, wherein the aliphatic group represented by $R_{31}$ or $R_{32}$ is an alkyl group having from 1 to 32 carbon atoms, an alkenyl group having from 2 to 32 carbon atoms, an alkynyl group having from 2 to 32 carbon atoms or an alicyclic hydrocarbon group having from 3 to 32 carbon atoms.

20. A silver halide color photographic light-sensitive material as claimed in claim 17, wherein the aromatic group represented by $R_{31}$ or $R_{32}$ is a phenyl group or a naphthyl group.

21. A silver halide color photographic light-sensitive material as claimed in claim 17, wherein the heterocyclic group represented by $R_{31}$ or $R_{32}$ is a 5- or 6-membered heterocyclic group which is constituted with a carbon atom and at least one hetero atoms selected from a nitrogen atom, an oxygen atom and a sulfur atom and which may be condensed with a benzene ring.

22. A silver halide color photographic light-sensitive material as claimed in claim 17, wherein a substituent for th substituted aliphatic group, the substituted aromatic group or the substituted heterocyclic group represented by $R_{31}$ or $R_{32}$ is an aryl group, a nitro group, a hydroxy group, a cyano group, a sulfo group, an alkoxy group, an aryloxy group, a carboxy group, an acyloxy group, an acylamino group, a sulfonamido group, a sulfamoyl group, a halogen atom, a carbamoyl group, an alkoxycarbonyl group, an acyl group, a sulfonyl group, a sulfinyl group, a heterocyclic group, an amino group, an alkylthio group or an arylthio group.

23. A silver halide color photographic light-sensitive material as claimed in claim 1, wherein the high speed reactive type coupler is represented by the following general formula (VII):

$$(R_{33}-A_1)_m Z \qquad \text{(VII)}$$

wherein m represents 1 or 2; $A_1$ represents a cyan image forming coupler residue having a phenol nucleus or a cyan image forming coupler residue having an α-naphthol nucleus; Z represents a group which is attached to the coupling position of the above-described coupler residue and capable of being released from the coupler (VII) upon the formation of dye through the oxidative coupling with an aromatic primary amine developing agent; and $R_{33}$ represents a hydrogen atom, an alkyl group having 30 or less carbon atoms which may be substituted, an alkoxy group having 30 or less carbon atoms which may be substituted, an aryloxy group which may be substituted, an acylamino group represented by the general formula (A), (B), (C) or (D) below or a carbamoyl group represented by the general formula (E) or (F) below.

$$-NH-CO-X \quad (A)$$
$$-NH-SO_2-X \quad (B)$$

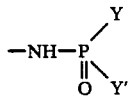
(C)

$$-NHCONH-X \quad (D)$$
$$-CONHX \quad (E)$$

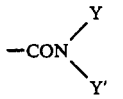
(F)

wherein X represents a straight chain or branched chain alkyl group having from 1 to 32 carbon atoms which may be substituted, a cyclic alkyl group which may be substituted or an aryl group which may be substituted; and Y and Y' each represents —X, —OX, —NH—X or $-NX_2$.

24. A silver halide color photographic light-sensitive material as claimed in claim 23, wherein a substituent for the alkyl moiety or the aryl moiety is a halogen atom, a nitro group, a cyano group, a hydroxy group, a carboxy group, an amino group, an aryl group, an alkoxycarbonyl group, an acyloxycarbonyl group, an amido group, an imido group, a carbamoyl group, a sulfamoyl group, an alkoxy group or an aryloxy group.

25. A silver halide color photographic light-sensitive material as claimed in claim 23, wherein the high speed reactive type coupler is represented by the following general formula (VIII) or (IX):

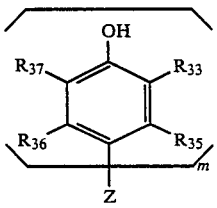
(VIII)

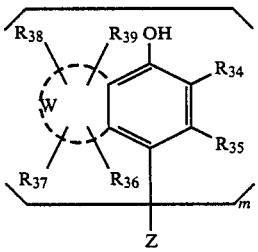
(IX)

wherein m, Z and $R_{33}$ each has the same meaning as defined in the general formula (VII); $R_{34}$ represents a hydrogen atom, an alkyl group having 30 or less carbon atoms or a carbamoyl group represented by the general formula (E) or (F); $R_{35}$, $R_{36}$, $R_{37}$, $R_{38}$ and $R_{39}$ each represents a hydrogen atom, a halogen atom, an alkyl group, an aryl group, an alkoxy group, an alkylthio group, a heterocyclic group, an amino group, a carbonamido group, a sulfonamido group, a sulfamoyl group or a carbamoyl group; and W represents a non-metallic atomic group necessary to form a 5- or 6-membered ring by ring closing.

26. A silver halide color photographic light-sensitive material as claimed in claim 1, wherein the photographic material comprises a support having thereon a silver halide emulsion layer.

27. A silver halide color photographic light-sensitive material as claimed in claim 26, wherein the silver halide emulsion layer contains the high speed reactive type coupler.

28. A silver halide color photographic light-sensitive material as claimed in claim 27, wherein the silver halide emulsion layer further contains the compound represented by the general formula (I).

29. A silver halide color photographic light-sensitive material as claimed in claim 1, wherein the compound represented by the general formula (I) is present in a range from 1 to 100 mol% per mol of coupler.

30. A silver halide color photographic light-sensitive material as claimed in claim 1, wherein the high speed reactive yellow color forming coupler is represented by the formula (II) or the high speed reactive cyan color forming coupler is represented by the formulae (VIII) or (IX):

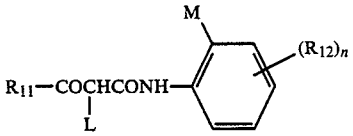
(II)

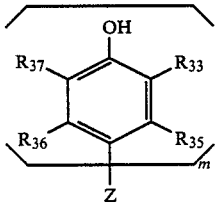
(VIII)

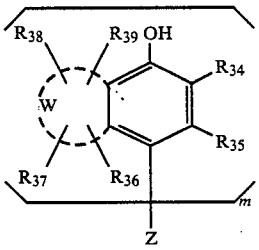
(IX)

wherein L represents a halogen atom, an $-SR_{16}$ group (wherein $R_{16}$ represents an alkyl group, an aryl group, a heterocyclic group or an acyl group), an $-OR_{17}$ group (wherein $R_{17}$ represents an alkyl group, an aryl group, a heterocyclic group or an acyl group) or an

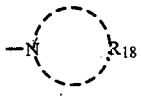

group (wherein $R_{18}$ represents a non-metallic atomic group necessary to form a 5- or 6-membered ring together with —N<); m of formulae (VIII) or (IX) represents 1 or 2; Z represents a group which is attached to the coupling position of the coupler residue of coupler (VIII) or (IX) and is capable of being released from the coupler (VIII) or (IX) upon the formation of a dye through oxidative coupling with an aromatic primary amine developing agent; $R_{33}$ represents a hydrogen atom, an alkyl group having 30 or less carbon atoms which may be substituted, an alkoxy group having 30 or less carbon atoms which may be substituted, an aryloxy group which may be substituted, an acylamino group represented by the general formulae (A), (B), (C) or (D) depicted below or a carbamoyl group represented by the general formulae (E) or (F) depicted below:

$$-NH-CO-X \quad (A)$$

$$-NH-SO_2-X \quad (B)$$

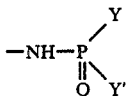
(C)

$$-NHCONH-X \quad (D)$$

$$-CONHX \quad (E)$$

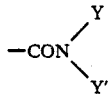
(F)

wherein X represents a straight chain or branched chain alkyl group having from 1 to 32 carbon atoms which may be substituted, a cyclic alkyl group which may be substituted or an aryl group which may be substituted; and Y and Y' each represents —X, —OX, —NH—X or $-NX_2$; $R_{34}$ represents a hydrogen atom, an alkyl group having 30 or less carbon atoms or a carbamoyl group represented by the general formulae (E) or (F) depicted above; $R_{35}$, $R_{36}$, $R_{37}$, $R_{38}$ and $R_{39}$ each represents a hydrogen atom, a halogen atom, an alkyl group, an aryl group, an amino group, a carbonamido group, a sulfonamido group, a sulfamoyl group or a carbamoyl group; and W represents a non-metallic atomic group necessary to form a 5- or 6-membered ring by ring closure.

31. A silver halide color photographic light-sensitive material as claimed in claim 30, said silver halide color photographic light-sensitive material exhibiting improved graininess in both high density areas and low density areas after imagewise exposure and development.

32. A method of producing an image in a silver halide color photographic light-sensitive material, comprising imagewise exposing and developing a silver halide color photographic light-sensitive material comprising a support having thereon a red-sensitive silver halide emulsion layer containing a cyan color forming coupler, a green-sensitive silver halide emulsion layer containing a magenta forming coupler and a blue-sensitive silver halide emulsion layer containing a yellow color forming coupler, at least one of the red-sensitive silver halide emulsion layer or blue-sensitive silver halide emulsion layer containing a high speed reactive coupler possessing a relative coupling speed of 0.6 to 1.0 represented by the following formulae (II), (III) or (IV) as the yellow color forming coupler for the blue sensitive layer or represented by the formula (VI) as the cyan color forming coupler for the red sensitive layer:

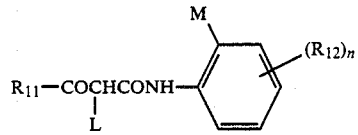
(II)

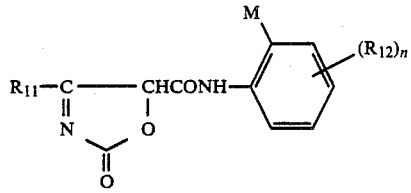
(III)

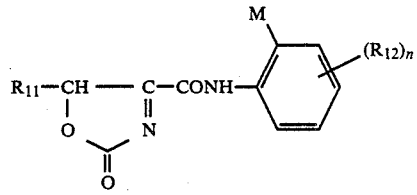
(IV)

$$(A)_m-Z \quad (VI)$$

wherein $R_{11}$ represents an alkyl group or an aryl group, each of which may be substituted; $R_{12}$ represents a substituent which can be substituted for a hydrogen atom attached to the benzene ring; n represents an integer of 1 or 2, and when n is 2, two substituents represented by $R_{12}$ may be the same or different; M represents a halogen atom, an alkoxy group or an aryloxy group; L represents a group capable of being released from the coupler upon the formation of a dye through oxidative coupling with an aromatic primary amine developing agent; A represents an image forming coupler residue which has a napthol nucleus or a phenol nucleus; m represents 1 or 2; and Z represents a group which is attached to the coupling position of the above-described coupler residue A and is capable of being released from coupler (VI) upon the formation of a dye through oxidative coupling with an aromatic primary developing agent; and a compound represented by the following general formula (I):

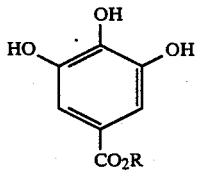
(I)

wherein R represents a hydrogen atom, a substituted or unsubstituted aliphatic group, a substituted or unsubstituted aromatic group, or a substituted or unsubstituted heterocyclic group;

wherein said silver halide color photographic light-sensitive material exhibits improved graininess in both high density areas and low density areas after imagewise exposure and development.

* * * * *